US010631654B2

(12) United States Patent
Odutayo

(10) Patent No.: US 10,631,654 B2
(45) Date of Patent: Apr. 28, 2020

(54) ADJUSTABLE MODULAR FRAME SYSTEM

(71) Applicant: 4rmiture & Co, Newark, NJ (US)

(72) Inventor: Ade Odutayo, Newark, NJ (US)

(73) Assignee: 4rmiture & Co, Newark, NJ (US)

( * ) Notice: Subject to any disclaimer, the term of this patent is extended or adjusted under 35 U.S.C. 154(b) by 0 days.

(21) Appl. No.: 16/679,939

(22) Filed: Nov. 11, 2019

(65) Prior Publication Data

US 2020/0069070 A1 Mar. 5, 2020

Related U.S. Application Data

(63) Continuation-in-part of application No. 15/657,760, filed on Jul. 24, 2017, now Pat. No. 10,470,582.

(60) Provisional application No. 62/381,351, filed on Aug. 30, 2016.

(51) Int. Cl.

| | |
|---|---|
| ***A47C 19/04*** | (2006.01) |
| ***A47C 7/00*** | (2006.01) |
| ***A47C 17/04*** | (2006.01) |

(52) U.S. Cl.

CPC ..... *A47C 19/04* (2013.01); *A47C 7/002* (2013.01); *A47C 17/04* (2013.01)

(58) Field of Classification Search

CPC ..... A47C 19/04
USPC ..... 5/181, 183–185, 282.1
See application file for complete search history.

(56) References Cited

U.S. PATENT DOCUMENTS

| | | | | |
|---|---|---|---|---|
| 1,080,577 A * | 12/1913 | Pascale et al. | ..... | A47C 17/68 5/114 |
| 4,016,612 A * | 4/1977 | Barile, Sr. | ..... | A47C 19/021 5/200.1 |
| 4,694,519 A * | 9/1987 | Benoit | ..... | A47C 19/02 403/205 |

* cited by examiner

*Primary Examiner* — Fredrick C Conley
(74) *Attorney, Agent, or Firm* — Millen, White, Zelano & Branigan, P.C.; William Nixon

(57) ABSTRACT

A frame system that is adjustable in size and shape is provided with components that move in relation to each other. The frame system uses two main bar rails having at least one short channel piece and a housing piece. The frame system also includes two side bar rails of at least one long channel piece and the housing piece. A pair of center bar rails attach to the side bar rails and include at least one strut extension piece and a strut housing piece attached to a center leg. The corner assemblies include a corner piece to receive an end of a main bar rail and an end of a side bar rail, a corner leg, and a bracket.

10 Claims, 34 Drawing Sheets

ADJUSTABLE MODULAR FRAME SYSTEM

FIELD OF THE INVENTION

The present invention relates to a modular frame system that is adjustable to fit a variety of sizes of furniture.

DESCRIPTION OF THE RELATED ART

Beds and other furniture usually consist of a mattress and a box spring that are supported by a bed support having two longitudinal rails attached to corner posts. A headboard, side board, or other component is attached to the corner posts. Each part of the furniture frame fixed to a size compatible with the mattress or cushion for the furniture. The frame is not adjustable, however, for different sized mattresses or cushions. Many times, the mattress or cushion wears out but the furniture frame is still in good condition. Replacement of the furniture requires purchase of a whole new frame along with the cushion if the cushion is a different size.

In the context of a sleep surface, most surfaces are elevated from the floor. Supports usually are assembled from several rigid struts that ensure that the sleep surface is supported on all edges while the rigid structure is not. In addition, these support structures allow for one to attach a headboard or footboard directly to the frame. In this configuration, the headboard and footboard may be mounted on the rigid support structure. Similarly, the frames for sofas, sectionals, love seats, and the like provide support to elevate the seats or cushions above the floor and provide structure on all edges of the seat.

SUMMARY OF THE INVENTION

The disclosed embodiments provide support for a sleep surface, such as a mattress or box spring, and a modern sofa or sectional frame. There is a need to have these structures morph into using the same structure to support sleep surfaces and furniture and, in the process, allow one the choice of configuration of the frame applicable to the desired modular furniture.

An adjustable modular frame system is disclosed. The adjustable modular frame system includes a plurality of corner assemblies placed in each corner of the system. Each corner assembly includes a corner piece attachable to a corner leg piece and bracket piece attached to the corner piece and the corner leg piece. The adjustable modular frame system also includes a pair of main bar rails located opposite each other. Each main bar rail includes a main housing piece having an enclosed passage that extends the length of the main housing piece. The main housing piece includes two receiving portions on the bottom of the main housing piece. Each main bar rail also includes a pair of short channel pieces movable with the main housing piece to adjust a length of the main bar rail. Each short channel piece fits into the enclosed passage of the main housing piece. The adjustable modular frame system also includes a pair of side bar rails located opposite each other. Each side bar rail includes a side housing piece having an enclosed passage that extends the length of the side housing piece. The side housing piece includes two receiving portions on the bottom of the side housing piece. Each side bar rail also includes a pair of long channel pieces movable within the side housing piece to adjust a length of the side bar rail. Each long channel piece fits into the enclosed passageway of the side housing piece. The adjustable modular frame system also includes a two center bar rails to connect to the pair of side bar rails. Each of the center bar rails includes a strut housing piece connected to a center leg piece. Each of the center bar rails also includes a pair of strut extension pieces to slidably fit into the strut housing piece. Each strut extension piece includes an end that fits into a receiving portion of the side housing piece. Each corner assembly receives an end for a side bar rail and an end from a main bar rail.

An adjustable modular frame system is disclosed. The adjustable modular frame system includes four corner assemblies positioned in each corner of the frame system. Each corner assembly includes a corner piece and a corner leg piece. The adjustable modular frame system also includes two main bar rails located opposite each other and between the corner assemblies. Each main bar rail includes a main housing piece and two short channel pieces. Each short channel piece connects to first arm of the corner piece. The adjustable modular frame system also includes two side bar rails located opposite each other and between the corner assemblies and perpendicular to the two main bar rails. Each side bar rail includes a side housing piece and two long channel pieces. Each long channel piece connects to a second arm of the corner piece. The adjustable modular frame system also includes two center bar rails located parallel to each other and between the side housing pieces of the two side bar rails. Each center bar rail includes a strut housing piece to receive two strut extension pieces and center leg piece. Each strut extension piece is connected to the side housing piece. The two main bar rails, the two side bar rails, and the two center bar rails are aligned to fit a specified size of a mattress or furniture.

An adjustable modular frame system is disclosed. The adjustable modular frame system includes a pair of first corner supports. Each first corner support includes a pair of rectangular tubes of different lengths connected to a leg. A first rectangular tube is connected to a U-channel insert and a second rectangular tube is connected to a support insert. The adjustable modular frame system also includes a pair of second corner supports. Each second corner support includes a pair of rectangular tubes of different lengths connect to a leg. A first rectangular tube is connected to the support insert. A second rectangular tube is connected to the U-channel insert. The first rectangular tube of the second corner support is longer than the first rectangular tube of the first corner support. The adjustable modular frame system includes pair of T-section supports connected to a center bar having a leg. The pair of T-section supports are connected to the support insert such that each T-section support is coupled to the second rectangular tube of a first corner support and the first rectangular tube of a second corner support. The pair of first corner supports, the pair of second corner supports, and the pair of T-section supports are adjustable in distance from each other using or more additional U-channel inserts or support inserts.

Another adjustable modular frame system also is disclosed. The adjustable modular frame system includes a plurality of legs placed in each corner of the system. The adjustable modular frame system also includes a pair of support rails located opposite each other. Each support rail includes a middle support piece having a channel on a bottom side. The channel is bounded by a bent portion and a flat support portion. The bent portion extends inwardly into the middle support piece. The middle support piece includes a slot located approximately midsection. Each support rail also includes a pair of adjustable support pieces movable within the middle support piece to adjust a length of the support rail. Each adjustable support piece fits into the middle support piece such that a side of the adjustable support piece engages the bent portion of the middle support piece. Each adjustable support includes a flatbar having two holes therein to overlap with a leg of the plurality of legs. The adjustable modular frame system also includes a pair of side rails located opposite each other. Each side rail includes a middle side piece having a lip extending inwardly to the system. The middle side piece includes a channel on a bottom side. Each side rail also includes a pair of adjustable side pieces movable within the middle side piece to adjust a length of the side rail. Each adjustable side piece has a lip extending inwardly to the system and fits into the middle side piece. The pair of adjustable side pieces connects to legs of the plurality of legs. The lip of the middle side piece and the lips of the adjustable side pieces are aligned. The adjustable modular frame system also includes a center rail to connect to the pair of support rails. The center rail includes a middle center piece connected to a leg piece. The center rail also includes a pair of connecting pieces to slidably fit into the middle center piece. Each connecting piece includes a tab on an end opposite the middle center piece. The tab fits into the slot of the middle support piece of the support rail. The pair of connecting pieces move within the middle center piece to adjust a length of the center rail.

Another adjustable modular frame system is disclosed. The adjustable modular frame system includes a pair of support rails. Each support rail has a middle support piece and a pair of adjustable support pieces movable within the middle support piece. Each of the pair of adjustable support pieces fit into a bent portion and a flat support portion of the middle support piece. The adjustable modular frame system also includes a pair of side rails. Each side rail has a middle side piece with a first lip and a pair of adjustable side pieces with second lips. The pair of adjustable side pieces is movable within the middle side piece. The second lips of the pair of adjustable side pieces fit underneath the first lip of the middle side piece. The adjustable modular frame system also includes a center rail having a middle center piece connected to a leg piece and a pair of connecting pieces movable within the middle center piece. Each of the pair of connecting pieces includes a tab to connect to a slot in the middle support piece. The adjustable modular frame system also includes a plurality of legs. Each leg is coupled to an adjustable support piece and an adjustable side piece. The pair of adjustable support pieces and the pair of adjustable side pieces, along with the pair of the connecting pieces are configurable to a desired size.

BRIEF DESCRIPTION OF THE DRAWINGS

Various other features and attendant advantages of the present invention will be more fully appreciated as the same becomes better understood when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

Figure 1A:
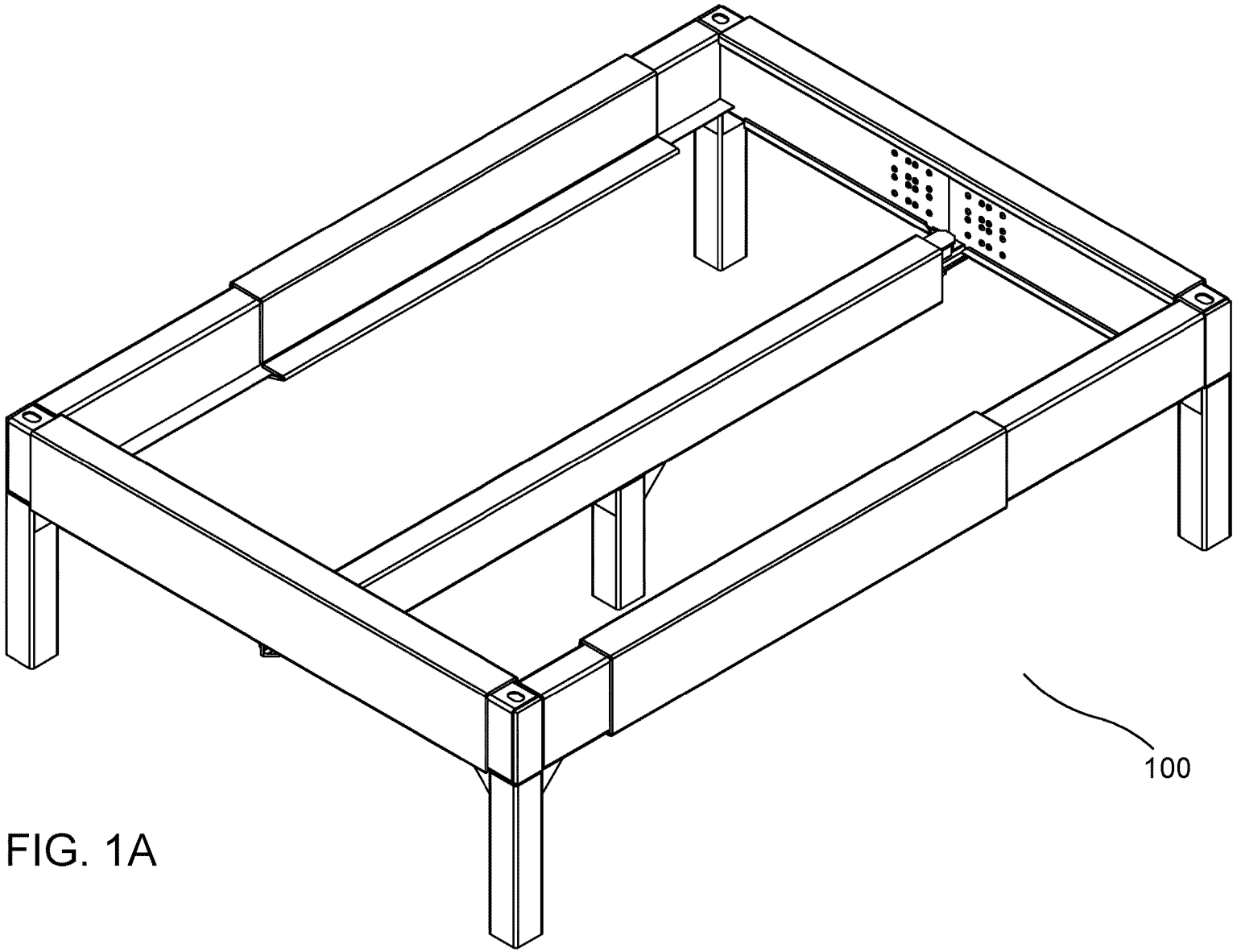
FIG. 1A illustrates a perspective view of an adjustable modular frame system according to the disclosed embodiments.
Figure 1B:
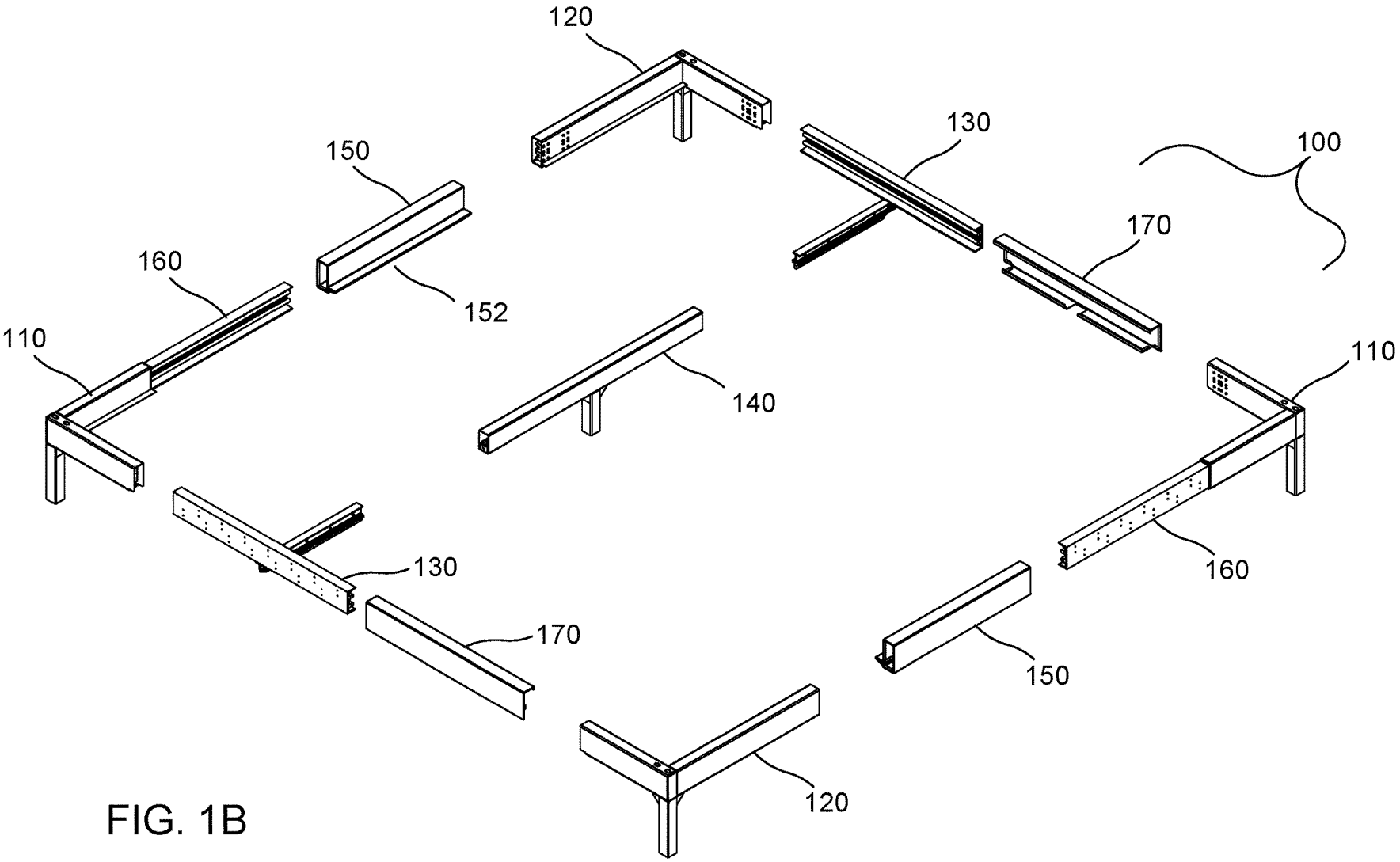
FIG. 1B illustrates an exploded view of the adjustable modular frame system of FIG. 1A according to the disclosed embodiments.
Figure 1C:
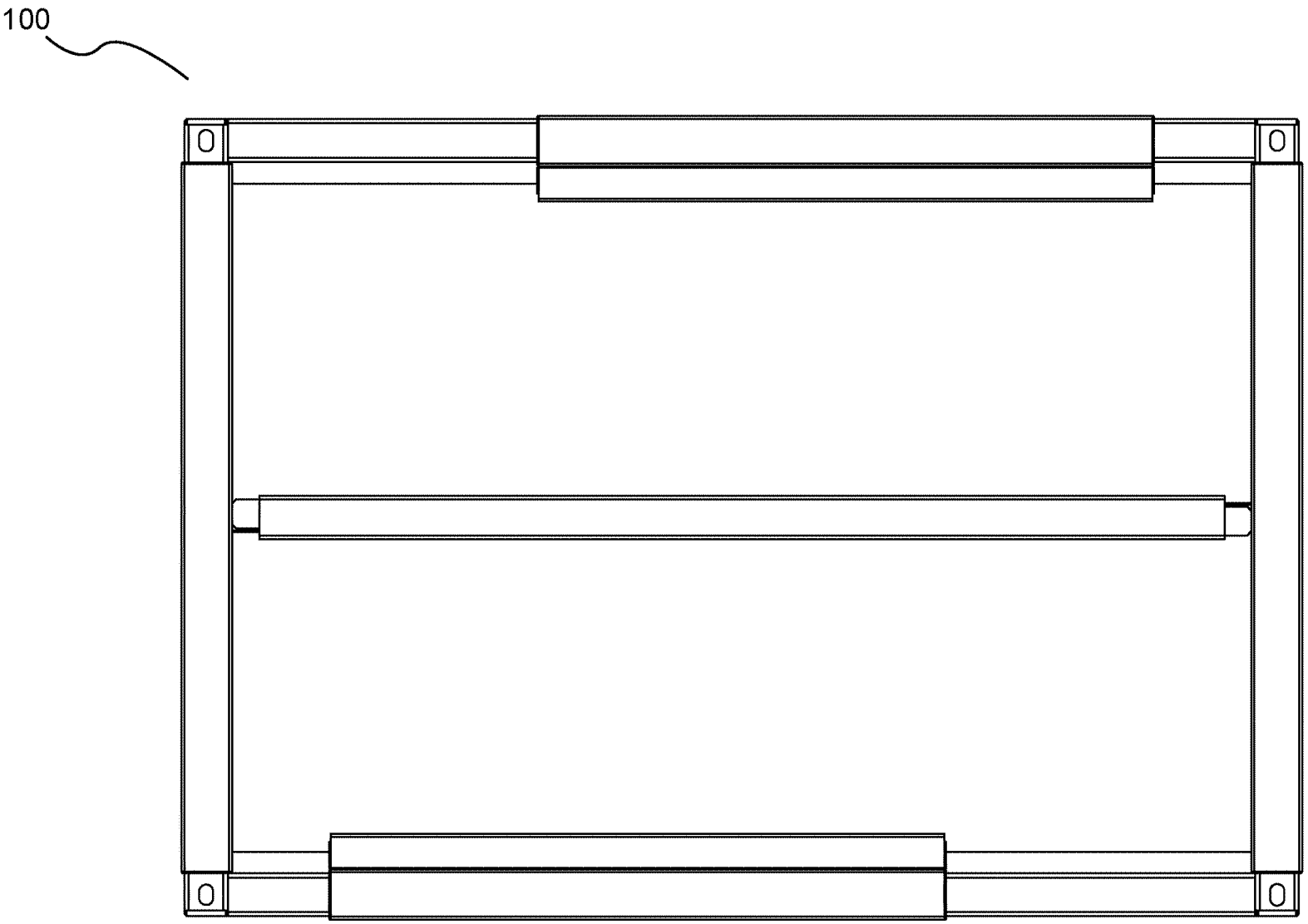
FIG. 1C illustrates a top view of the adjustable modular frame system of FIG. 1A according to the disclosed embodiments.
Figure 1D:
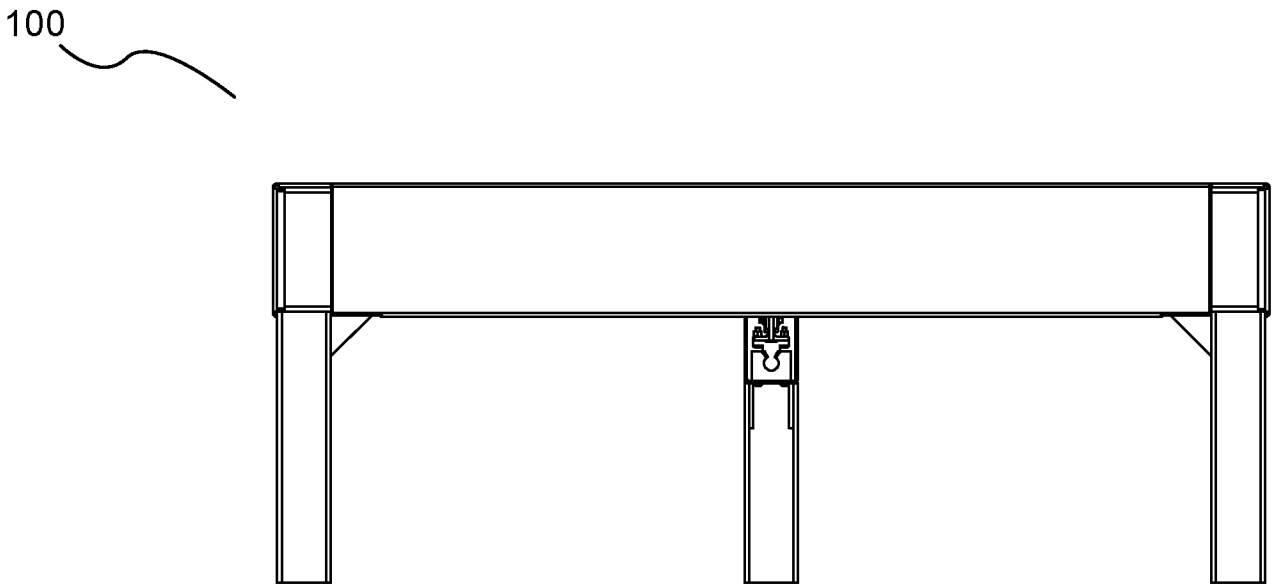
FIG. 1D illustrates a front or back view of the adjustable modular frame system of FIG. 1A according to the disclosed embodiments.
Figure 1E:
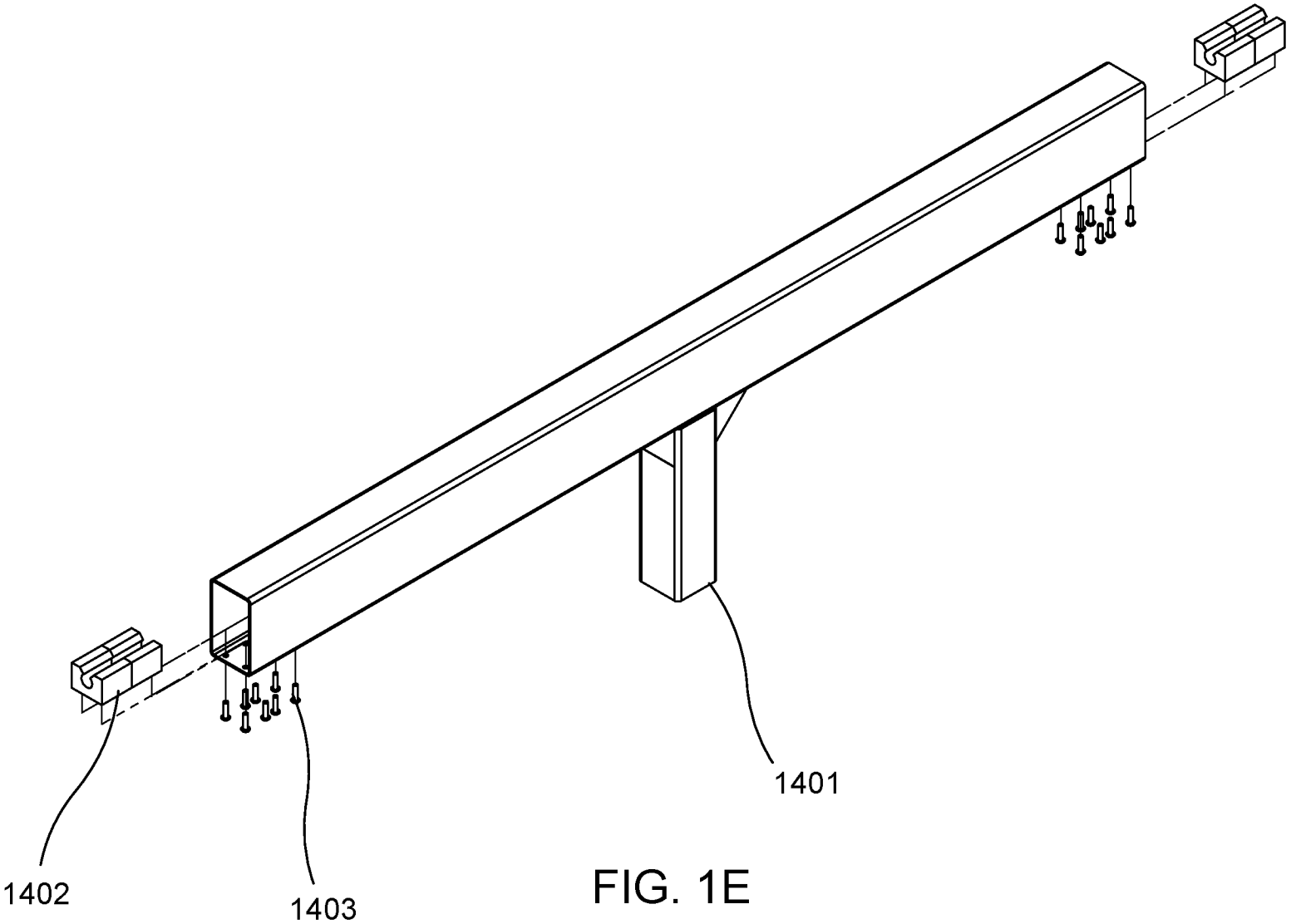
FIG. 1E illustrates an exploded view of a center bar of the adjustable modular frame system of FIG. 1A according to the disclosed embodiments.
Figure 1F:
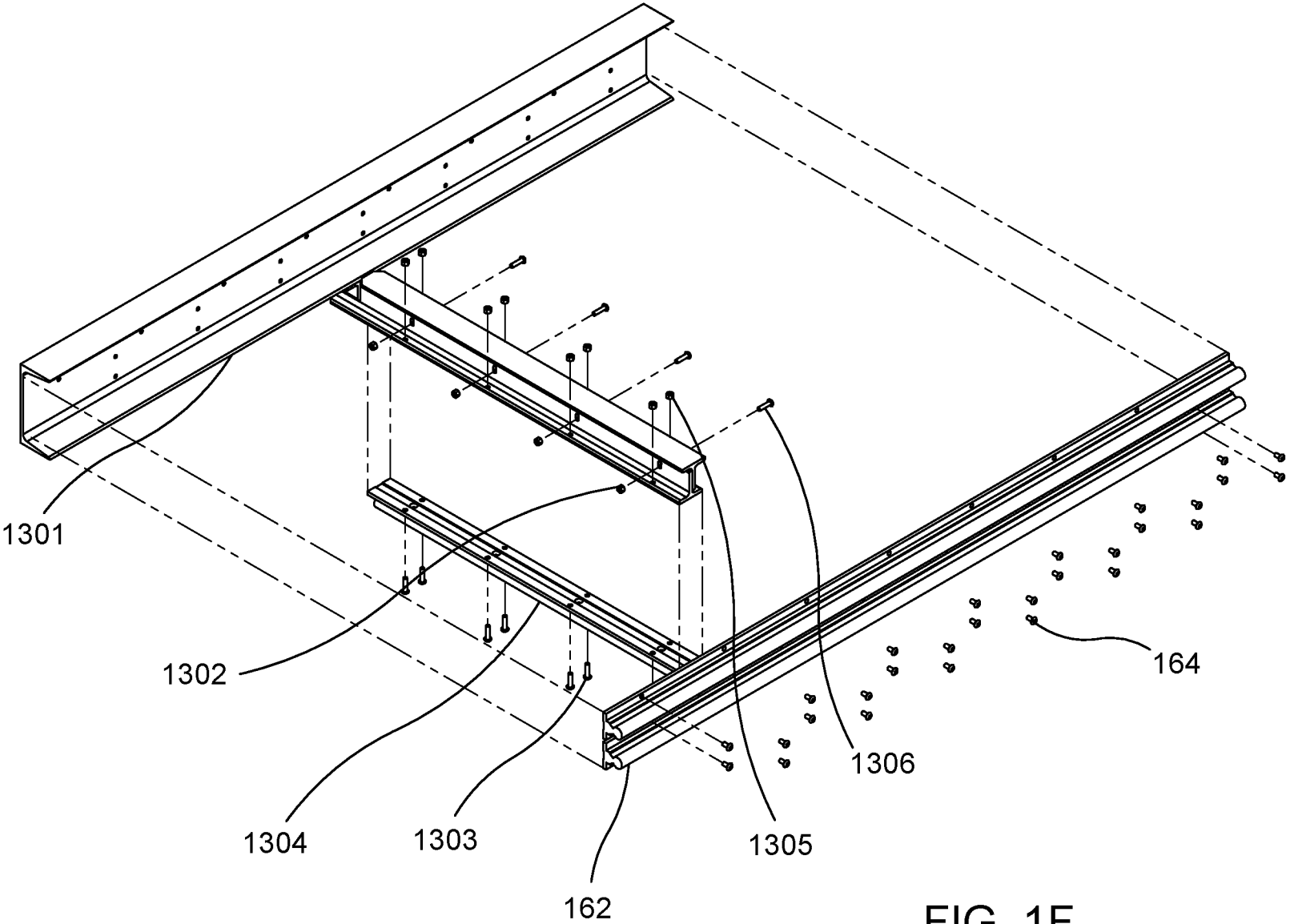
FIG. 1F illustrates an exploded view of a T-section support of the adjustable modular frame system of FIG. 1A according to the disclosed embodiments.
Figure 1G:
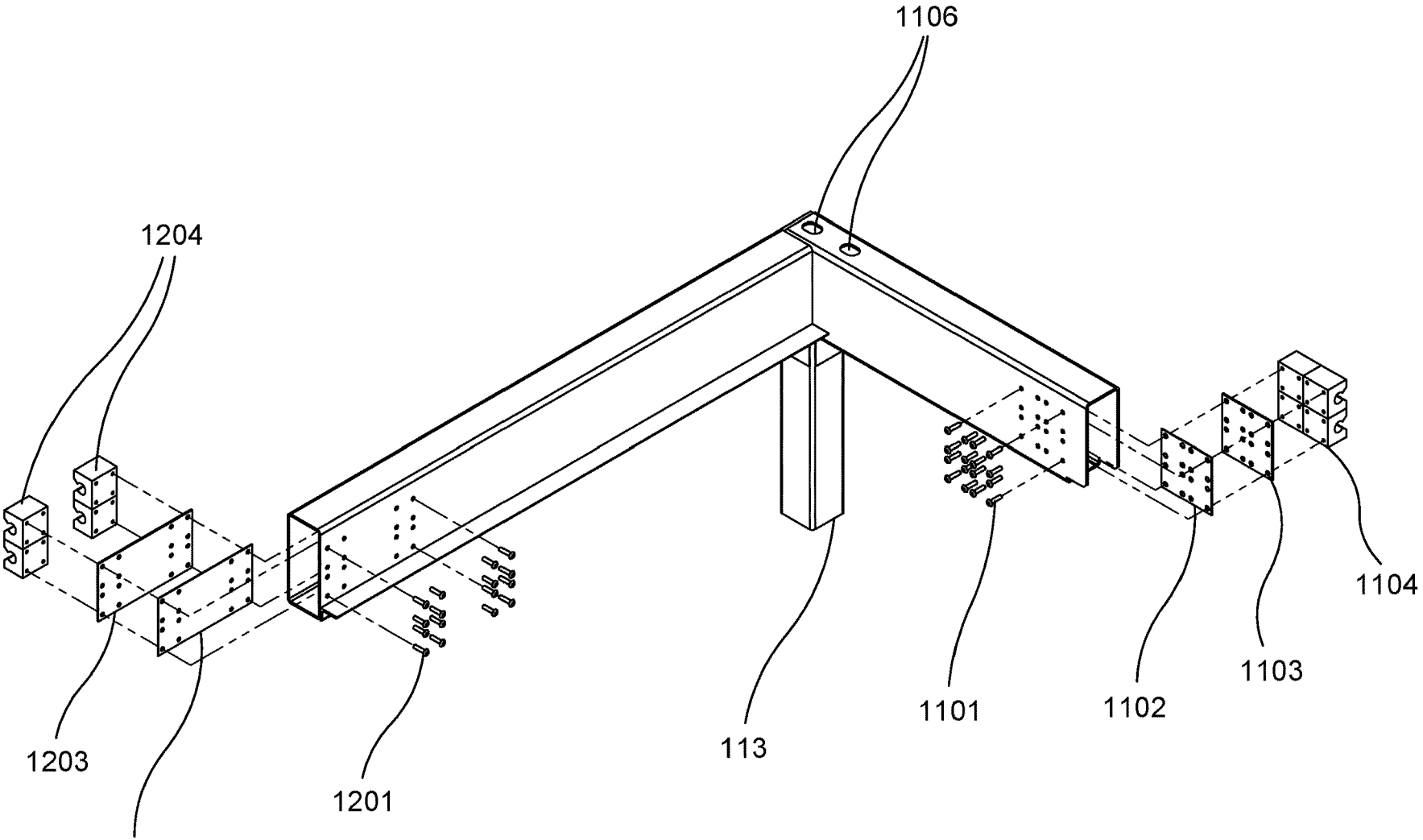
FIG. 1G illustrates an exploded view of a second corner support of the adjustable modular frame system of FIG. 1A according to the disclosed embodiments.
Figure 1H:
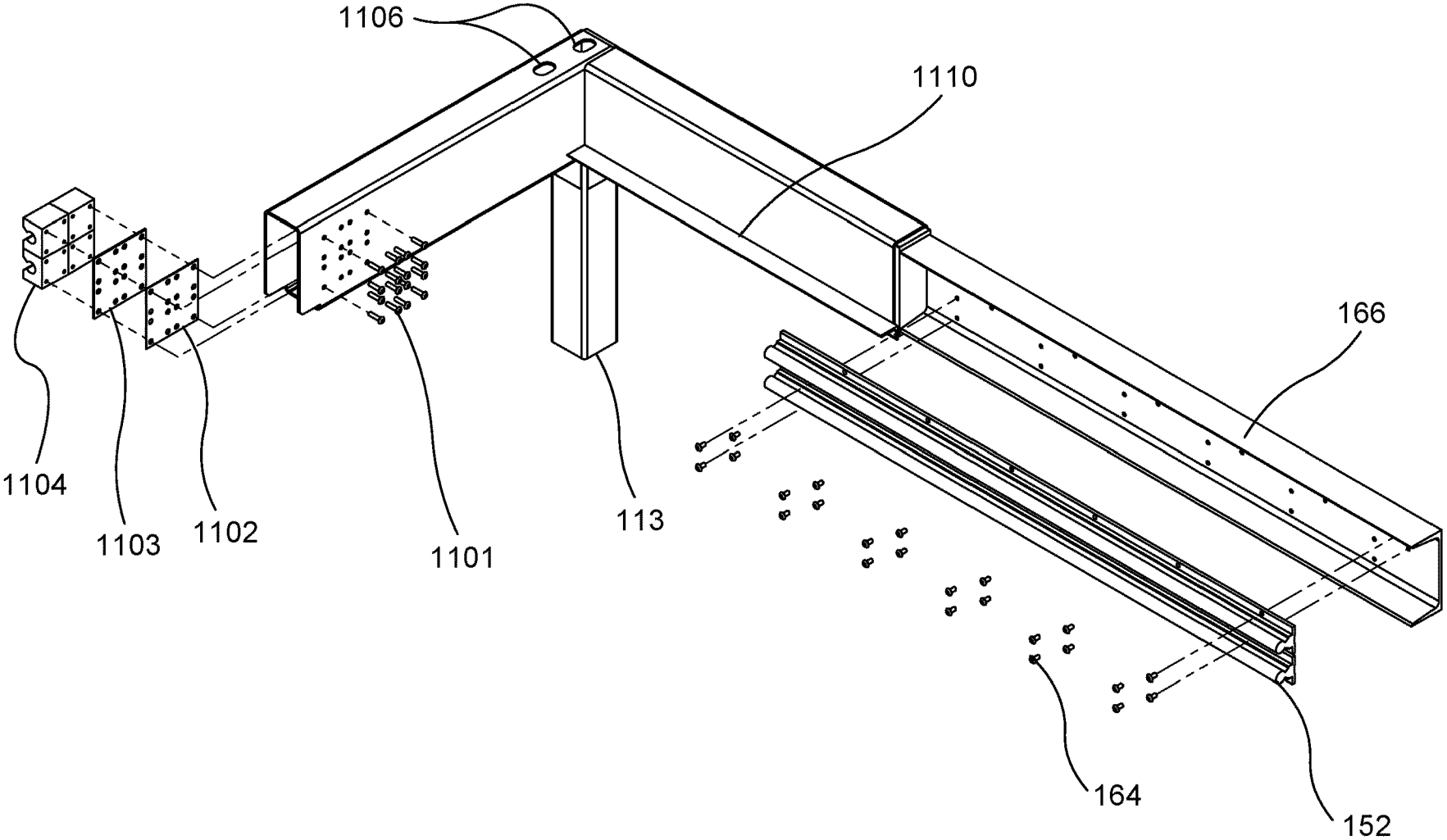
FIG. 1H illustrates an exploded view of a first corner support of the adjustable modular frame system of FIG. 1A according to the disclosed embodiments.
Figure 1I:
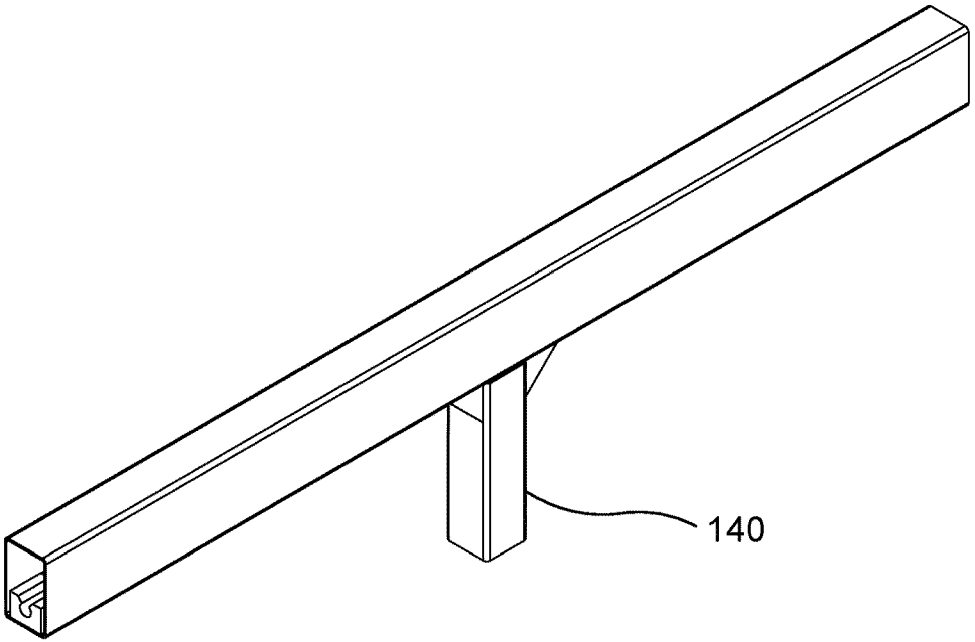
FIG. 1I illustrates a perspective view of the center bar according to the disclosed embodiments.
Figure 1J:
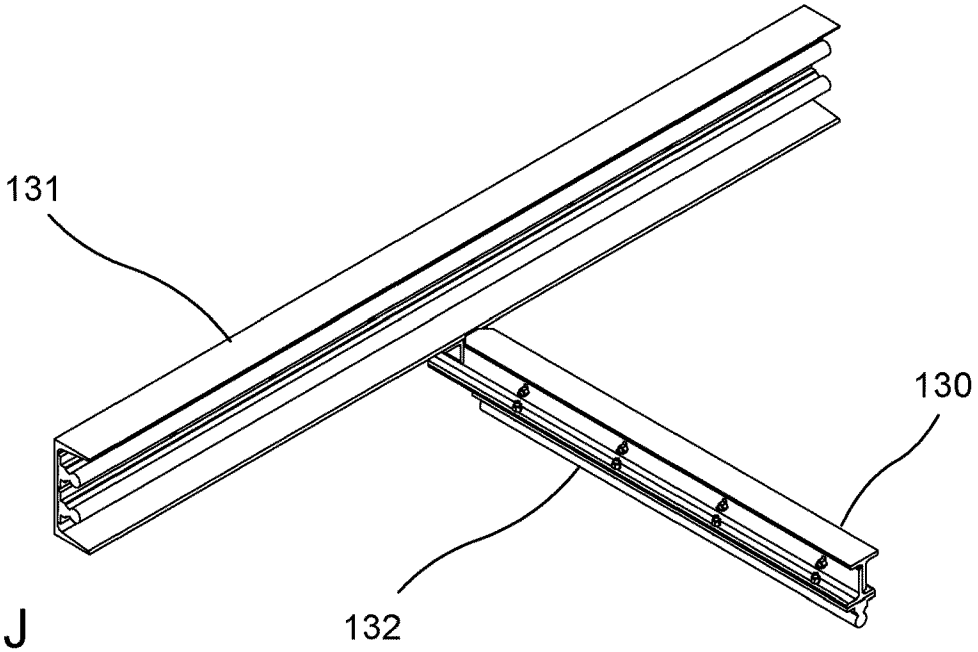
FIG. 1J illustrates a perspective view of the T-section support according to the disclosed embodiments.
Figure 1K:
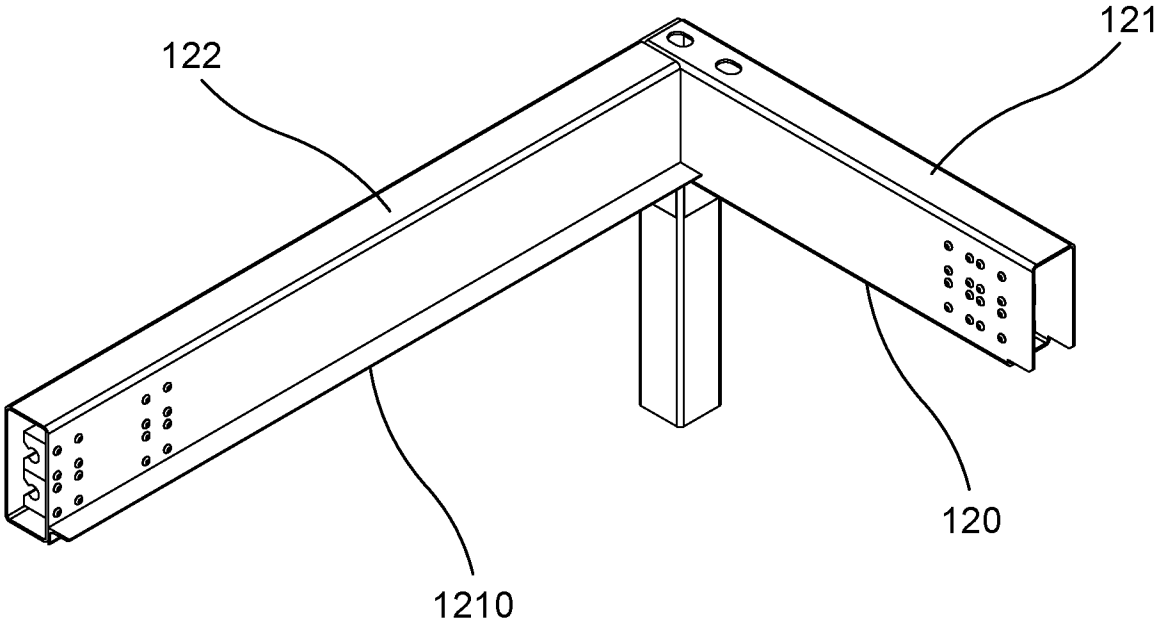
FIG. 1K illustrates a perspective view of the second corner support according to the disclosed embodiments.
Figure 1L:
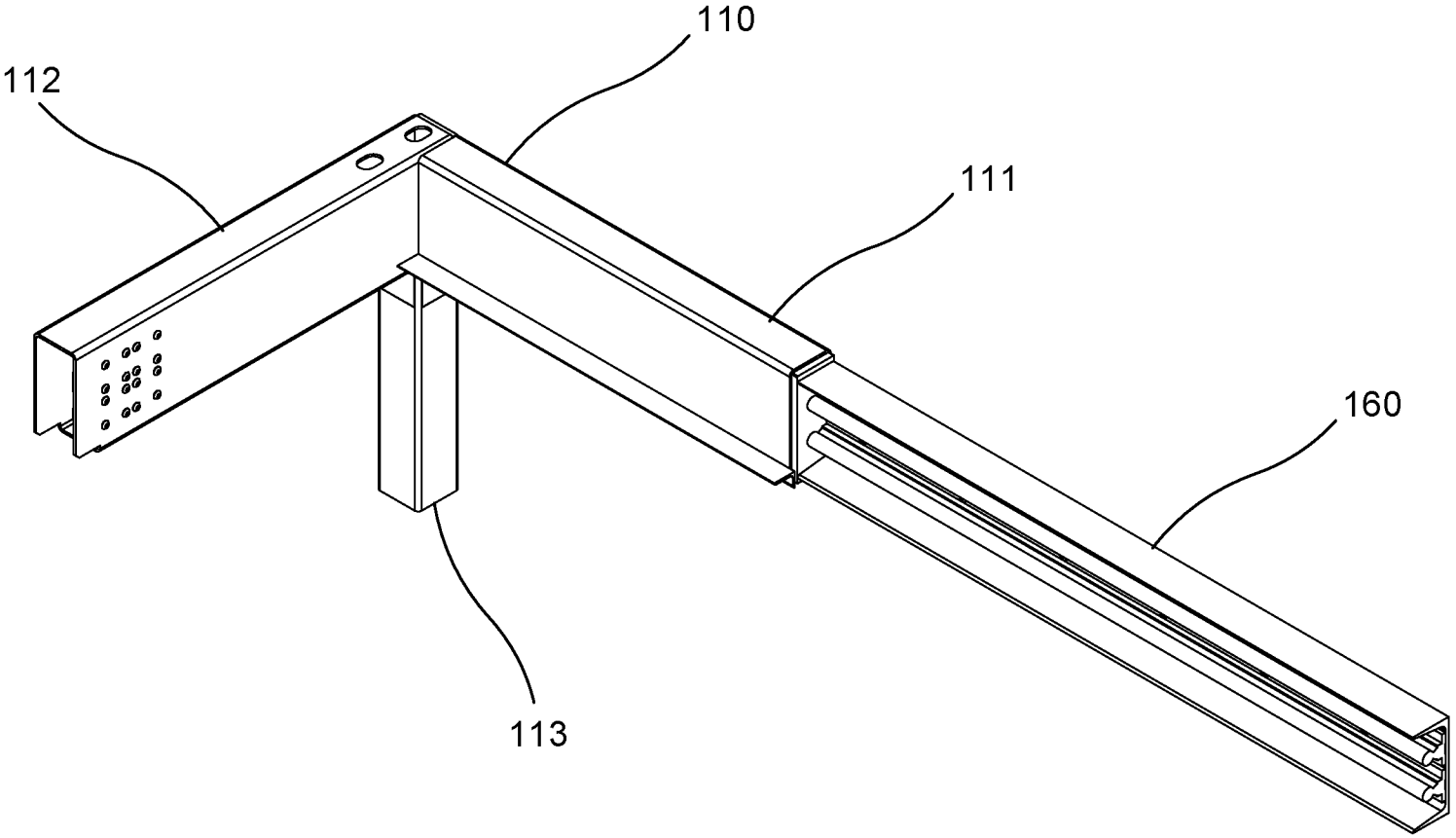
FIG. 1L illustrates a perspective view of the first corner support according to the disclosed embodiments.

FIGS. 1A-L depict an adjustable modular frame system 100 according to some embodiments. These figures show the different components of system 100. FIGS. 1A, 1C, and 1D depicts views of system 100 assembled without being adjusted beyond its smallest configuration. FIG. 1B depicts an exploded view of a disassembled system 100. FIGS. 1E, 1F, 1G, and 1H depict exploded views of the various components disclosed below. FIGS. 1I, 1J, 1K, and 1L depict perspective views of these components.

System 100 is adjustable in the lengthwise and widthwise directions. System 100 includes at least six distinct pieces that comprise the four sided member with one edge connected to a pair of adjacent but parallel edges. Each edge has an opposite edge with one set of parallel edges having an extended lip on the interior to allow support for a flat surface, such as a mattress, box spring, or cushion. Flat objects may rest on system 100 without the probability of slippage. A center bar extends in the same direction of the pair of edges with the lip and at the same planar level of the aforementioned edges. Preferably, system 100 is about 448.56 mm high, 1561 mm long, and 1119.53 mm wide, before it is expanded or adjusted. System 100 may be adjusted to fit any size, length, and width.

System 100 includes a pair of first corner supports 110, a pair of second corner supports 120, a pair of T-section supports 130, a center bar 140, and U-channel inserts 160 for support pieces 150. These components may be adjusted as needed to vary the dimensions of system 100. Each component is disclosed in greater detail below.

First corner supports 110 are located in opposite corners of system 100. Second corner supports 120 are located in the other corners. Thus, each side of system 100 includes one first corner support 110 and one second corner support 120. First corner support 110 includes a pair of rectangular tubes 111 and 112 extending perpendicularly so as to form a 90 degree angle. As shown, first rectangular tube 111 is slightly longer than second rectangular tube 112. The rectangular tubes also may be known as "arms." The rectangular tubes are connected to leg 113, which may be a tubular square that rests on the floor, ground, or surface.

First rectangular tube 111 connects to rectangular U-channel insert 160 having a rectangular end cup. First rectangular tube 111 also includes lip 1110, which extends inwardly to a center area enclosed by system 100. Rectangular U-channel insert 160 is enclosed by support piece 150, which includes lip 152. Lips 1110 and 152 are used to support the flat surface of the cushion, mattress, and the like for furniture. Second rectangular tube 112 extends perpendicularly from first rectangular tube 111. Second rectangular tube 112 attaches to T-section support 130. Second rectangular tube 112 includes a set of holes to receive screws 1101 that secure adapter parts 1102, 1103, and 1104 that receives the tracks of T-section support 130. Second rectangular tube 112 also includes holes 1106 that allow for other objects to slide into system 100 for a firm support. Preferably, the number of holes from screws 1101 is sixteen while the number of holes 1106 is 2.

As shown with first corner support 110, U-channel insert 160 includes track 162 that attaches to outer portion 166 with screws 164. Tracks 162 allows U-channel insert 160 to mate with second corner support 120, as disclosed below. First rectangular tube 111, however, receives U-channel insert 160 without engaging track 162.

Components of first corner support 110 may have the following dimensions. Preferably, first rectangular tube 111 is about 140 mm by 60 mm by 3 mm. The square lip on first rectangular tube 111 may be about 30 mm by 30 mm by 30 mm.

Second corner support 120 also includes a first rectangular tube 121 and a second rectangular tube 122. First rectangular tube 121 and second rectangular tube 122 are connected at a perpendicular angle at leg 113. Tubes 121 and 122 differ from tubes 111 and 112 of first corner support 110. For example, second rectangular tube 122 may be longer than first rectangular tube 111, while second rectangular tube 112 is about at the same size as first rectangular tube 121.

Second rectangular tube 122 includes square lip 1210 extending inwardly to a center area enclosed by system 100. First rectangular tube 121 includes a rectangular end cup attached on the outer most edge away from leg 113. Both tubes 121 and 122 include sets of sixteen holes to receive screws 1101 and 1201, respectively. First rectangular tube 121 uses the holes and screws 1101 to secure adapter parts 1102, 1103, and 1104 that receives the tracks of T-section support 130. Thus, first rectangular tube 121 may face or touch second rectangular tube 112 of first corner support 110. Second rectangular tube 122 uses the holes and screws 1201 to secure adapter parts 1202, 1203, and 1204. Adapter parts 1202, 1203, and 1204 differ from adapter parts 1102, 1103, and 1104 as they are longer. Adapter parts 1202, 1203, and 1204 receive tracks 162 of U-channel insert 160. First rectangular tube 121 also includes holes 1106 located above leg 113.

Corner supports 110 and 120 may be connected directly together using the track assemblies of U-channel insert 160 and T-section support 130. The respective rectangular tube may engage the tracks. T-section supports 130 may be placed between second rectangular tube 112 and first rectangular tube 121. These are the tubes without lips. T-section supports 130 also connect with center bar 140 to provide support within system 100.

T-section support 130 includes upper part 131 and lower part 132. Upper part 131 may engage rectangular tubes 112 and 121, while lower part 132 engages center bar 140. Lower part 132 is located below upper part 131 and extends perpendicularly inwards to frame 100. Preferably, upper part 131 is longer then lower part 132.

Upper part 131 houses the track section of T-section support 130. Thus, track 162 is secured by screws 164 to outer portion 1301. Preferably, twenty eight holes and screws are placed intermittently in pairs across the length of track 162. Track 162 couples or engages with the adaptors used in first corner support 110 and second corner support 120. Lower part 132 includes support bar 1302, or T-section, that attaches to channel track 1304 using screws 1302, 1303, and 1305.

Center bar 140 is placed between two T-section supports 130 and engages lower parts 132. In other words, lower parts 132 hold center bar 140. Center bar 140 may be a horizontal tube that placed perpendicularly to T-section support 130. It acts as a base for system 100. Center bar 140 includes leg 1401 held in place by a pair of triangular gussets. Center bar 140 also includes two sets of adapters 1402 and 1403 placed at the open ends. Adapter 1402 includes a channel to engage channel track 1304. Thus, center bar 140 is secured between T-section supports 130.

System 100 also includes support piece 150, as disclosed above. Support piece 150 may enclose U-channel insert 160, which includes track 162. Support piece 150 may engage first rectangular tube 111 of first corner support 110 and second rectangular tube 122 of second corner support 120. Support piece 150 includes lip 152. Lip 152 may be slightly larger than lips 1110 and 1210. Support piece 150 may act as a bridge protector between first corner support 110 and second corner support 120. System 100 may extend or contract without any damage to the underlying components. For example, various sizes of U-channel insert 160 may be used to adjust the size of system 100. Support piece 150 also may vary in size to accommodate the size of a U-channel insert 160. As shown in FIG. 1, support piece 150 may cover the rectangular tubes on the outside.

Head accessory 170 acts as a protective encasement, or back cover, for rectangular tubes 112 and 121. As such, head accessory 170 may cover upper part 131 of T-section support 130.

Using the disclosed configuration, system 100 may be adjusted in size and shape. First corner supports 110 may provide a fixed part to hold U-channel inserts 160. As indicated above, the systems may act as a frame that expands length-wise and width-wise. The process by which the frame can be expanded is a manual process. The individual attempting the expansion may pull length-wise and width-wise. The system expansion has indicators informing the user of the appropriate length markers for the possible mattress size i.e. twin, full, queen and king configurations. These markers provide the appropriate dimensions for the user.

FIGS. 2A-E disclose another adjustable module frame system 200 according to the disclosed embodiments. System 200 differs from system 100 in terms of components and configuration. Further, system 200 may be lighter in weight and easier to store than system 100. System 200, however, is adjustable to accommodate a variety of furniture pieces like system 100. One may adjust the pieces disclosed herein to configure system 200 to any size frame.

Figure 2A:
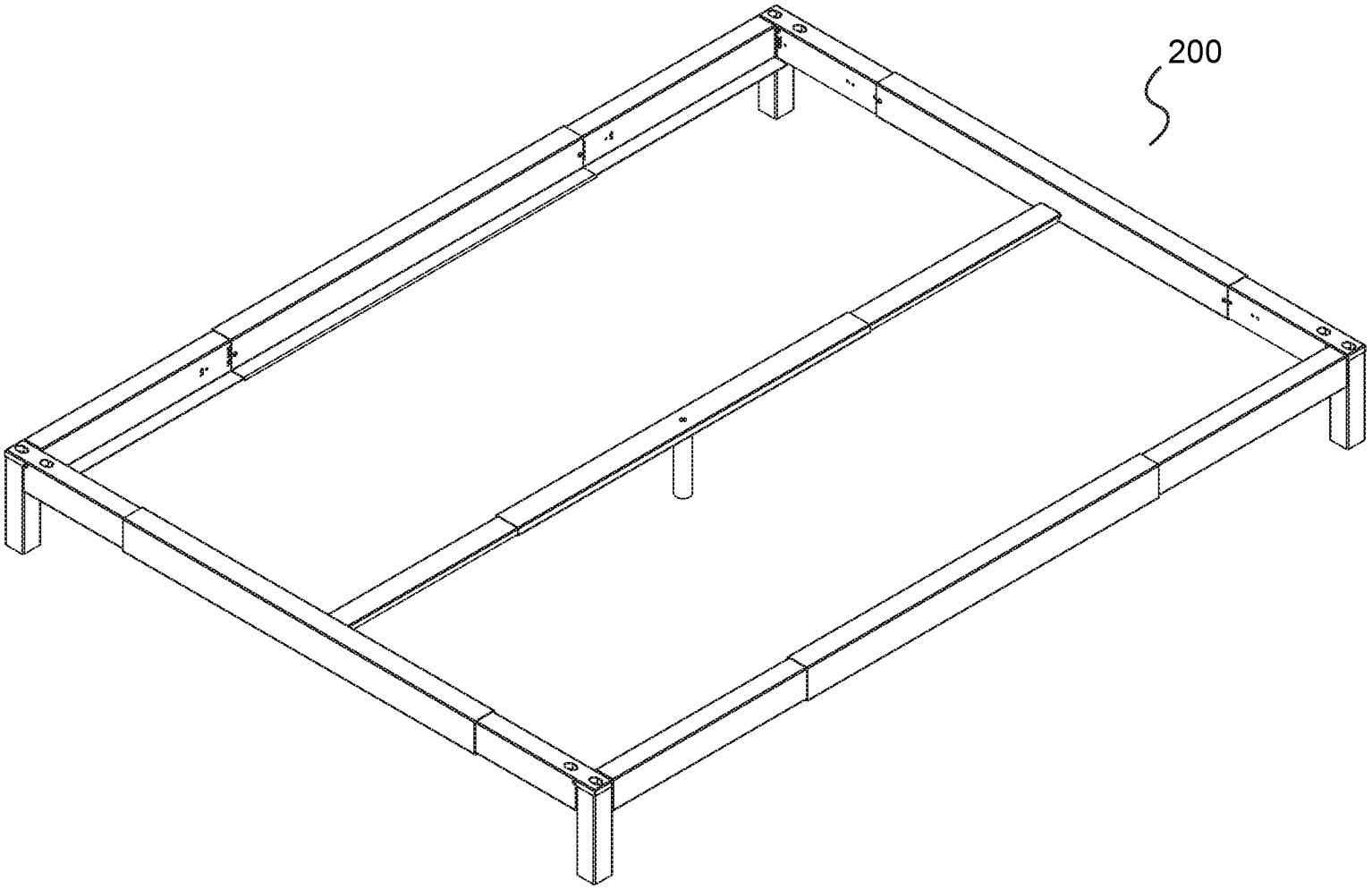
FIG. 2A illustrates a perspective view of another adjustable modular frame system according to the disclosed embodiments.
Figure 2B:
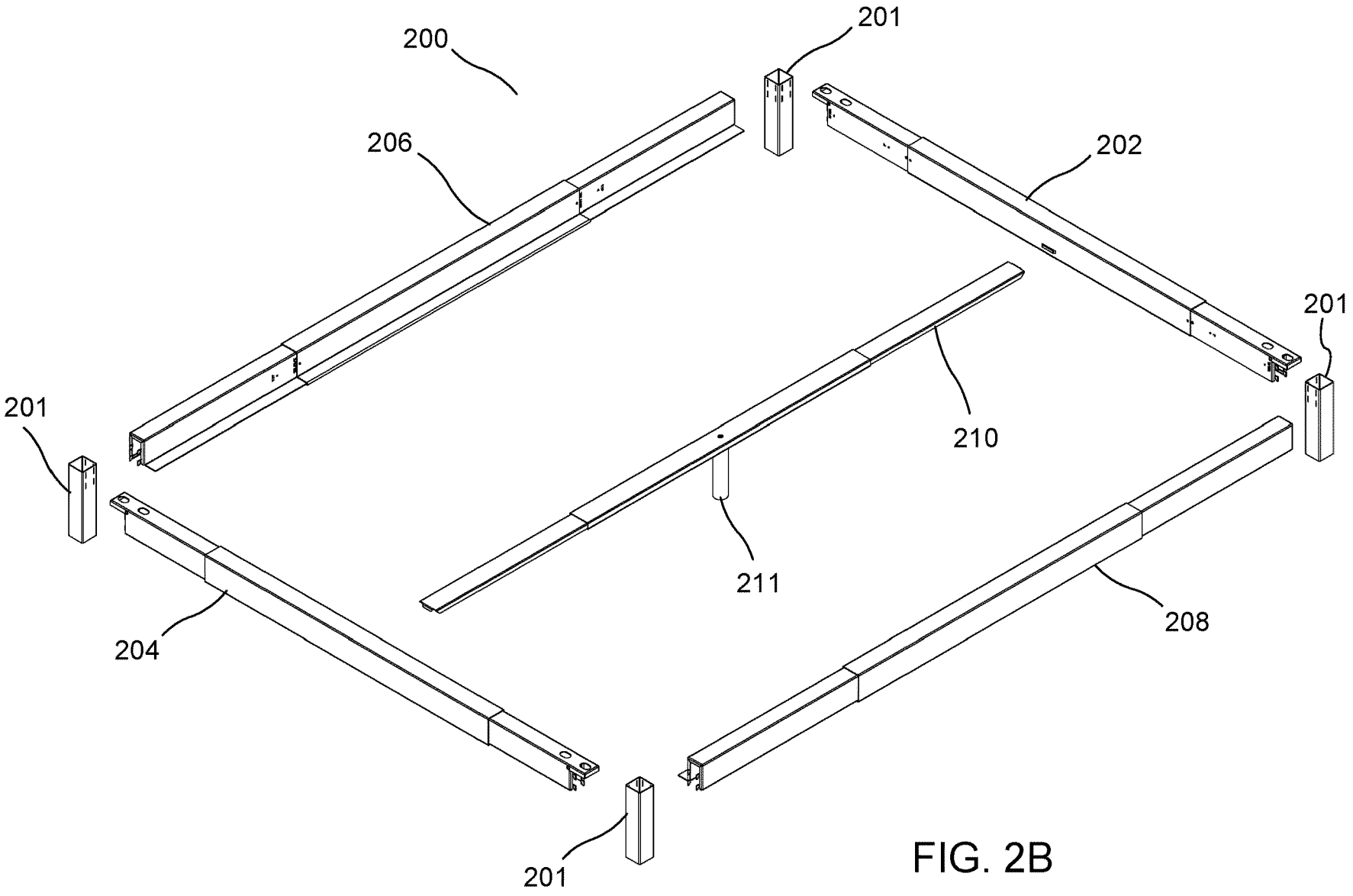
FIG. 2B illustrates an exploded view of the adjustable modular frame system of FIG. 2A according to the disclosed embodiments.

Referring to FIG. 2A, system 200 is shown assembled. Preferably, FIG. 2A depicts system 200 at its "smallest" configuration. None of the pieces have been adjusted to accommodate larger pieces of furniture. FIG. 2B depicts an exploded view of system 200 and includes the different components assembled therein.

As shown, system 200 includes a plurality of legs 201 that support the rest of system 200 on a surface. System 200 also includes a pair of support rails 202 and 204 located opposite each other. Support rail 202 may be referred to as the top support rail and support rail 204 may be referred to as the bottom support rail. Alternatively, support rails 202 and 204 may be referred to as the width-wise rails. System 200 also includes a pair of side rails 206 and 208. Side rail 206 may be referred to as the left side rail and side rail 208 may be referred to as the right side rail. Side rails 206 and 208 include lips that support the piece of furniture within system 200. System 200 also includes center rail 210 that connects to top support rail 202 and bottom support rail 204 to provide a center support piece for the piece of furniture. Preferably, center rail 210 includes a leg piece 211. All of these components of system 200 are disclosed in greater detail below.

Figure 2C:
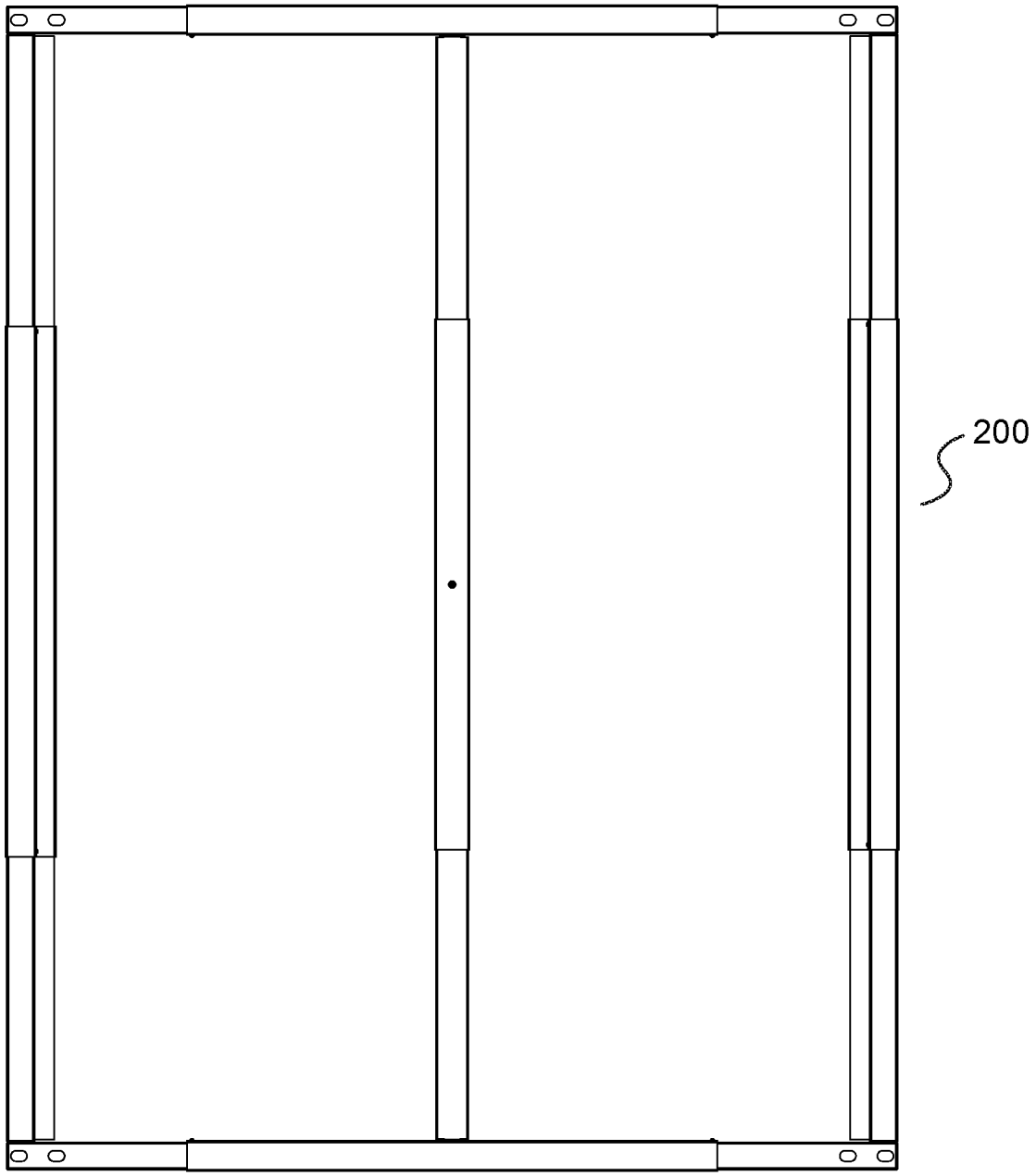
FIG. 2C illustrates a top view of the adjustable modular frame system of FIG. 2A according to the disclosed embodiments.
Figure 2D:
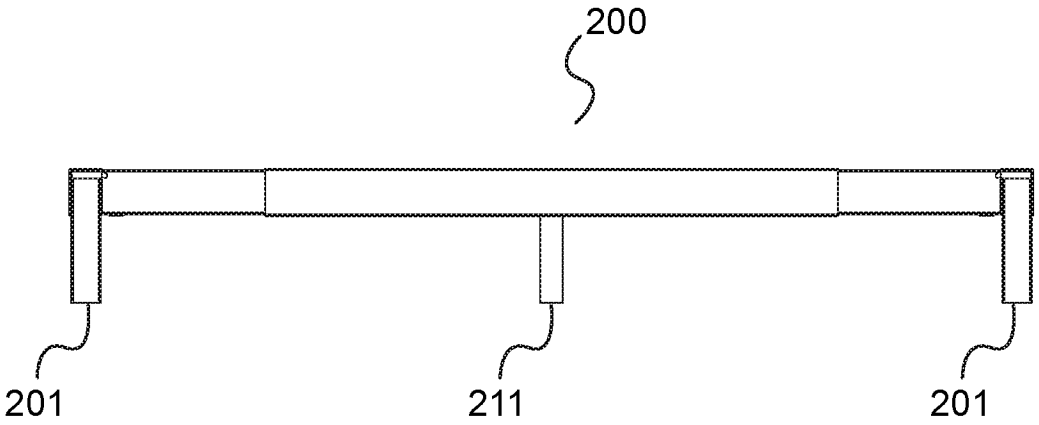
FIG. 2D illustrates a top or bottom view of the adjustable modular frame system of FIG. 2A according to the disclosed embodiments.
Figure 2E:
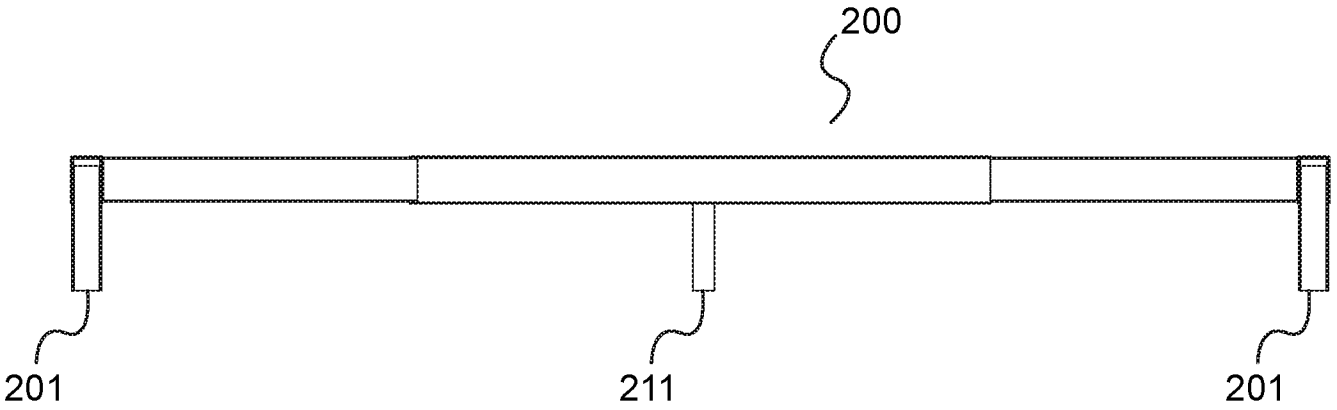
FIG. 2E illustrates a side view of the adjustable modular frame system of FIG. 2A according to the disclosed embodiments.

FIG. 2C depicts a top view of system 200. Center rail 210 is located about midway between side rails 206 and 208 and connected to support rails 202 and 204. The lips of side rails 206 and 208 also may be seen. FIG. 2D depicts a top or bottom view of system 200. FIG. 2D also may be known as a width-wise view of system 200. As can be seen, legs 201 differ from leg piece 211. Leg piece 211 may be shorter in length than legs 201. FIG. 2E depicts a side view of system 200. FIG. 2E also may be known as a length-wise view of system 200. The relationship between legs 201 and leg piece 211 may be shown in greater detail.

Figure 3C:
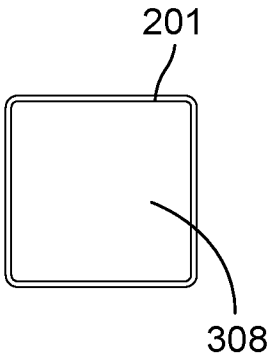
FIG. 3C illustrates a top view of the leg of FIG. 3A according to the disclosed embodiments.
Figure 3B:
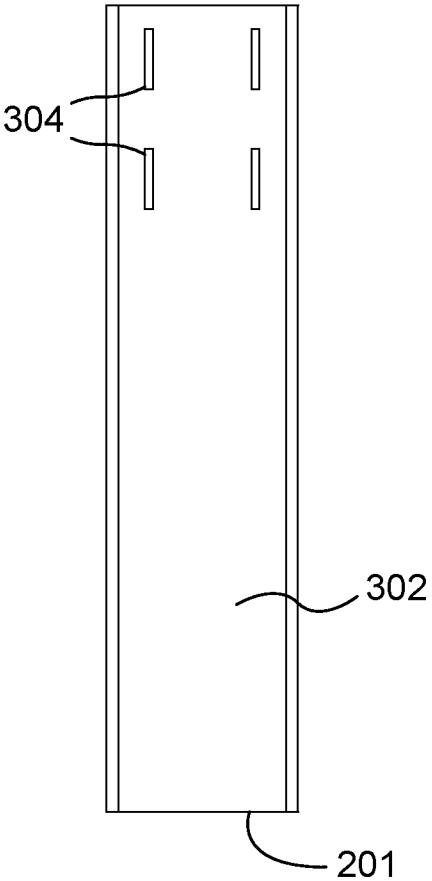
FIG. 3B illustrates a side view of the leg of FIG. 3A according to the disclosed embodiments.
Figure 3A:
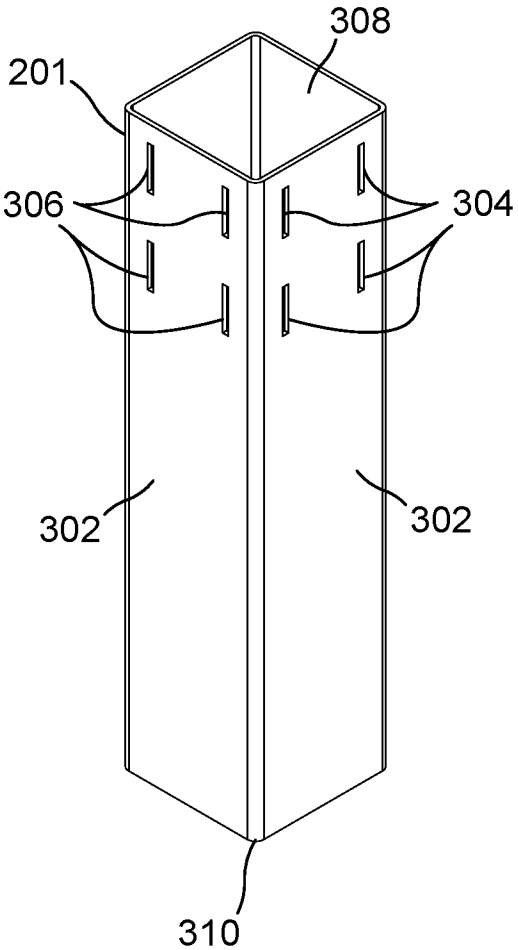
FIG. 3A illustrates a perspective view of a leg for the adjustable modular frame system according to the disclosed embodiments.

The separate components and pieces of system 200 are disclosed in greater detail. FIGS. 3A-C depict a leg 201 of the plurality of legs according to the disclosed embodiments. Legs 201 may be located in the corners of system 200. As shown, system 200 includes four legs 201 that connect with support rail 202 or 204 and side rail 206 or 208. In some embodiments, additional legs 201 may be used, as needed. Leg 201 may have a substantially square cross-sectional shape with rectangular-shaped sides 302. Sides 302 may have a length between 8 centimeters (cm) and 9 cm and a width between 1.5 cm to 2.5 cm. More preferably, sides 302 may a length of about 8.425 cm and a width of about 2 cm.

Leg 201 also includes slots 304 and 306. In some embodiments, slots 304 face towards support rail 202 or 204 and slots 306 face towards side rail 206 or 208. Alternatively, slots 304 and 306 may be on sides 302 opposite each other such that each side includes slots. Slots 304 and 306 are sets of four slots, though any number of slots may be used. The slots received protrusions from the rails, disclosed in greater detail below. Slots 304 and 306 may have dimensions of a width of about 0.085 cm and a length of about 0.625 cm. Slots 304 and 306 may include two top slots with tops of about 0.25 cm from an end of side 302. Two bottom slots may be about 1.5 cm from the end of side 302, as shown in FIG. 3B. The slots also may be two slots on each side that are spaced apart from each other by about 1.112 cm and located about 0.444 cm from the edges of side 302. Referring to FIG. 2C, leg 201 may include a hollow center 308 to configure the leg as square tubing. Leg 201 also includes edges 310, which are rounded. This prevents the use of sharp edges when assembling system 200.

FIGS. 4A-J depicts a support rail 202 for system 200 according to the disclosed embodiments. Although top support rail 202 is shown, FIGS. 4A-H also may apply to bottom support rail 204. Support rail 202 may attach to two legs 201 using flatbars 411 and mounting projections 420. Mounting projections 420 fit into slots 304 and 306 of legs 201.

Figure 4A:
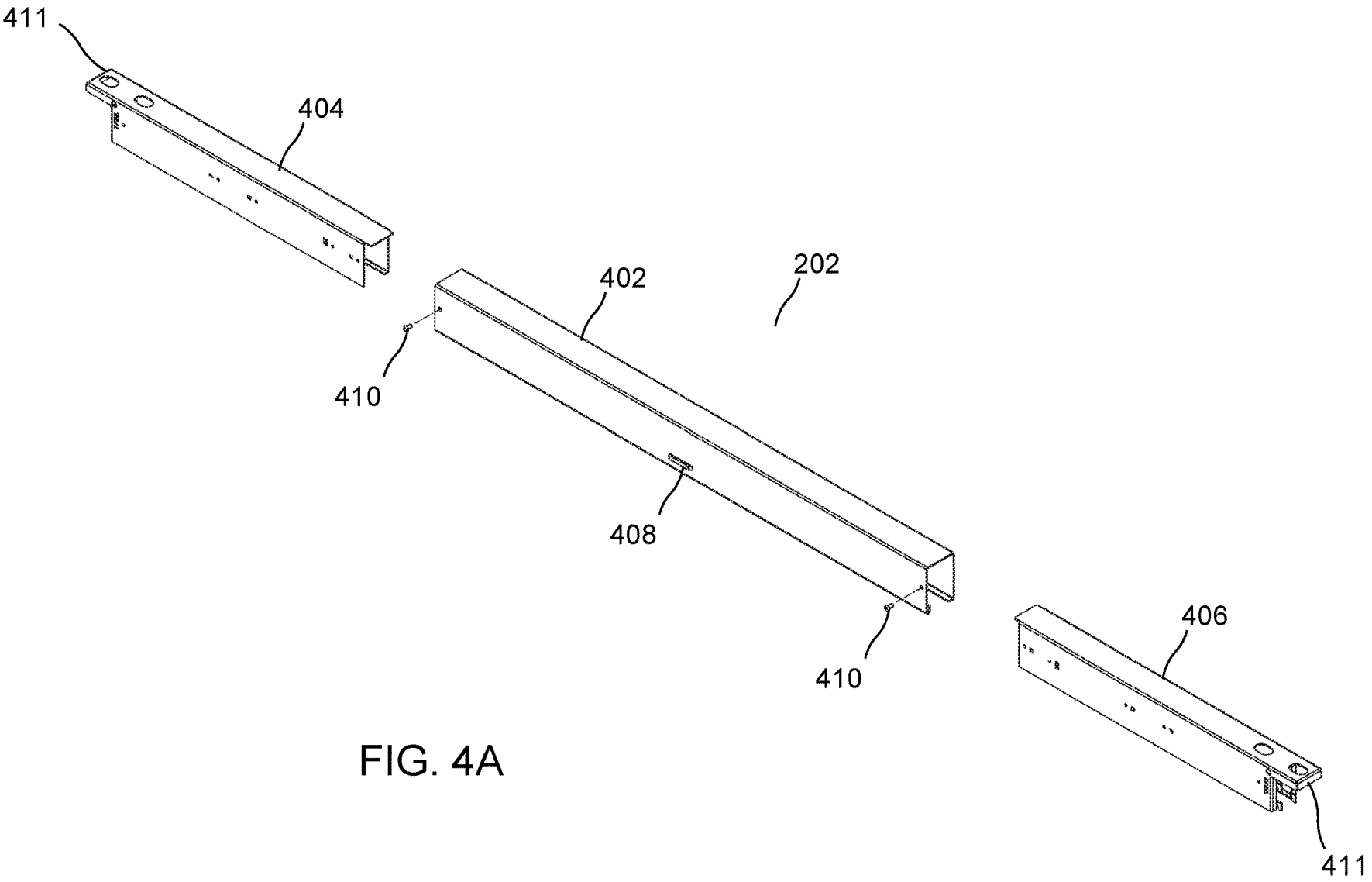
FIG. 4A illustrates an exploded view of a support rail for the adjustable modular frame system of FIG. 2B according to the disclosed embodiments.

FIG. 4A depicts an exploded view of support rail 202. Support rail includes a middle support piece 402 and a pair of adjustable support pieces 404 and 406. Adjustable support piece 404 may be the left side adjustable support piece. Adjustable support piece 406 may be the right side adjustable support piece. Middle support piece 402 shown in FIG. 4D also includes a slot 408 located approximately in the middle of the middle support piece. Slot 408 receives a tab from center rail 210. Slot 408 may be flat with a length of about 1.42 cm.

Figure 4B:
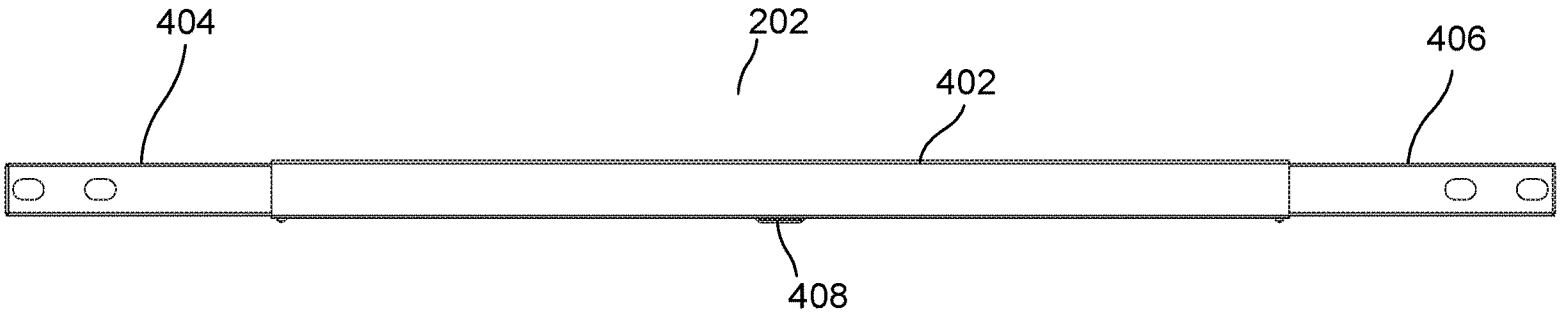
FIG. 4B illustrates a top view of the support rail according to the disclosed embodiments.
Figure 4C:
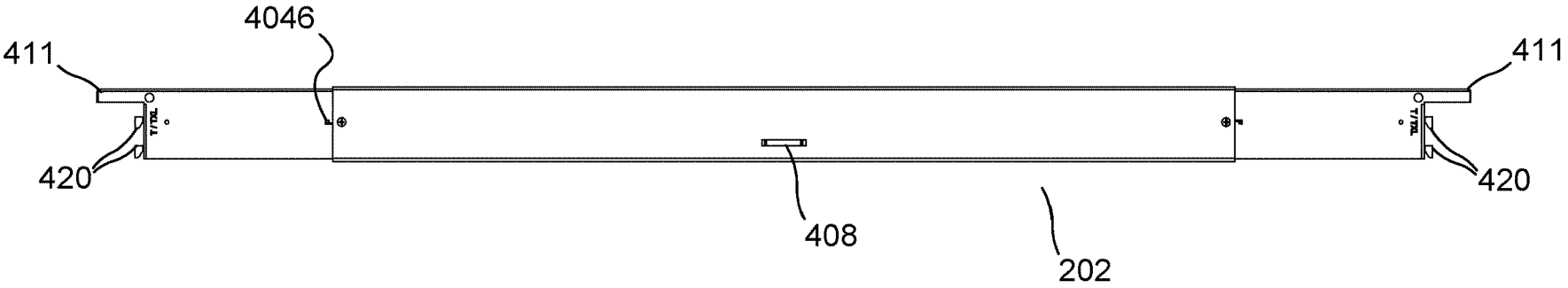
FIG. 4C illustrates a side view of the support rail according to the disclosed embodiments.

As can be seen in FIG. 4A, adjustable support pieces 404 and 406 fit inside middle support piece 402 such that they are movable to adjust the length of support rail 202. Screws 410 may insert through a hole 4025 on each side of middle support piece 402 and into a corresponding hole 4048 on adjustable support pieces 404 and 406. The holes in the adjustable support pieces may correspond to a desired size for system 200. Referring to FIG. 4H, markings 4046 indicate the size for corresponding holes 4048. Using a bed example, the markings may indicate the hole to insert screw 410 to achieve the desired size for the bed. Thus, markings 4046 may indicate twin, full, queen, California king, and king sizes. One moves adjustable support piece 404 or 406 within middle support piece 402 to align with the proper marking and inserts screw 410 into the holes. A nut may engage screw 410 to provide further stability for system 200.

Figure 4E:
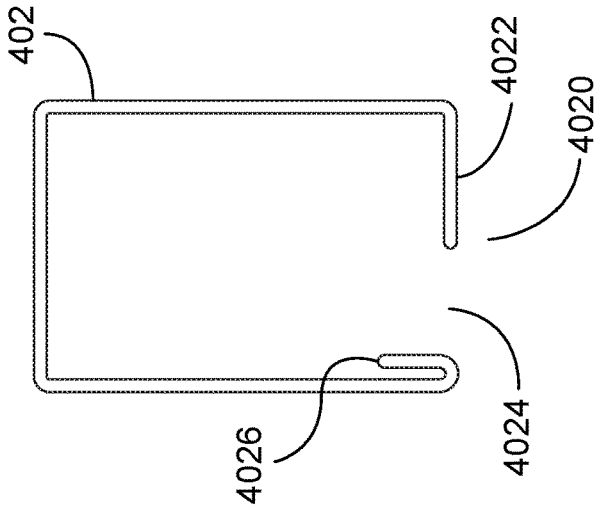
FIG. 4E illustrates a side view of the middle support piece according to the disclosed embodiments.
Figure 4D:
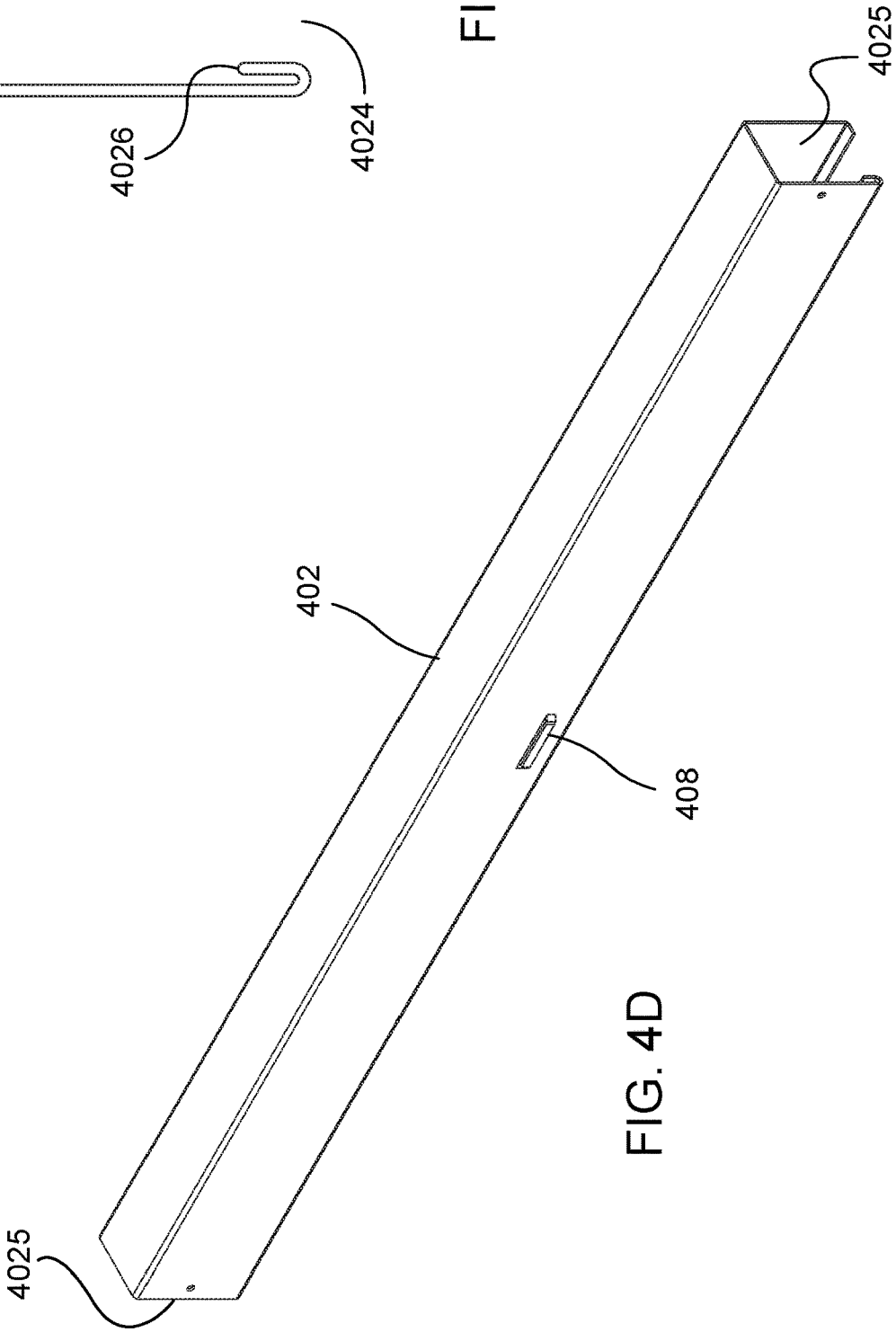
FIG. 4D illustrates a perspective view of a middle support piece of the support rail of FIG. 4A according to the disclosed embodiments.
Figure 4F:
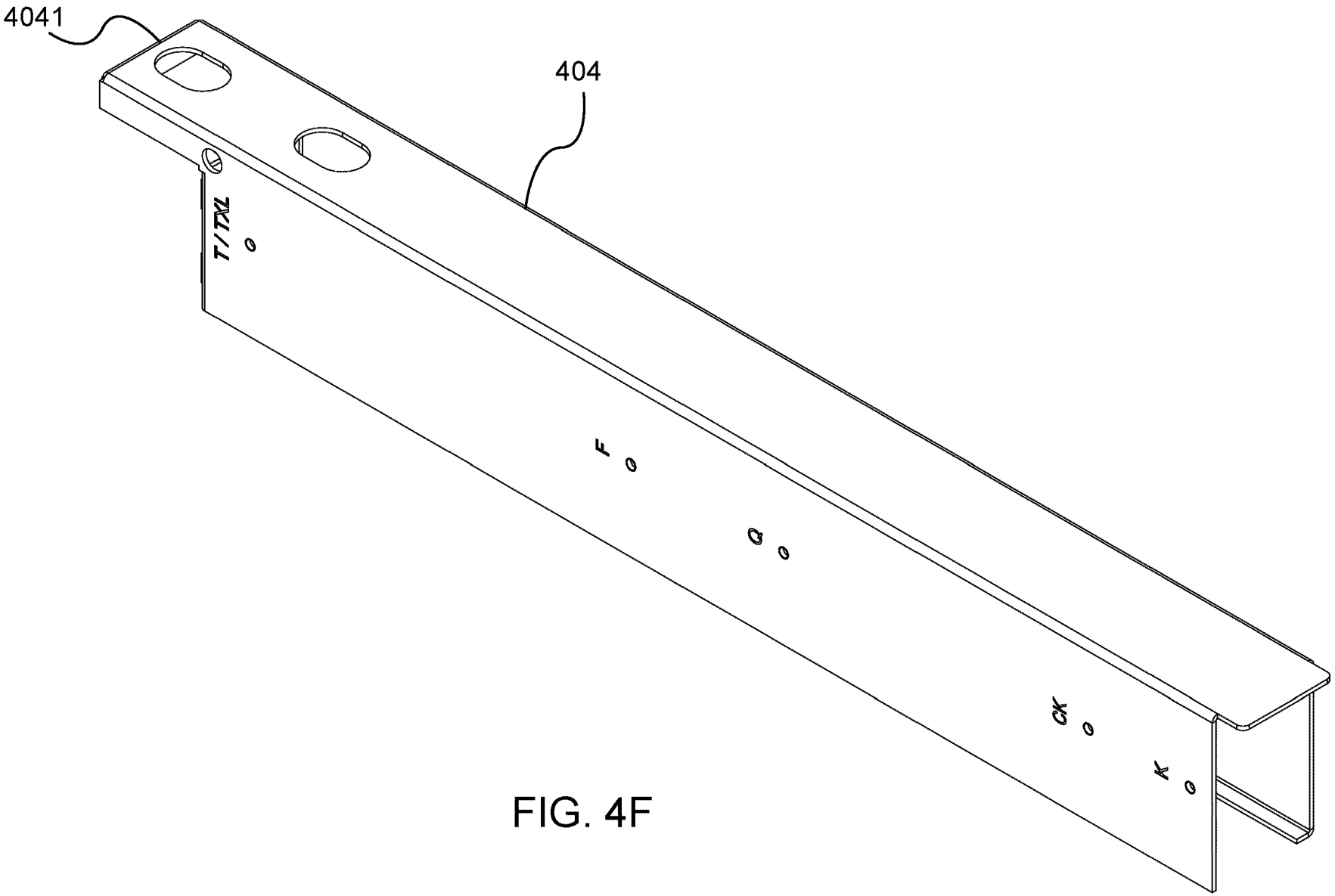
FIG. 4F illustrates a perspective view of an adjustable support piece of the support rail of FIG. 4A according to the disclosed embodiments.

FIG. 4E depicts a side view of middle support piece 402. Middle support piece 402 is hollow with a bottom side 4020. Bottom side 4020 includes a channel 4024. Channel 4024 is bounded by a flat support portion 4022 and a bent portion 4026. Flat support portion 4022 may extend about halfway across bottom side 4020. Bent portion 4026 extends inwardly into the hollow midsection of middle support piece 402. Bent portion 4026 provides a groove to engage a side 4045 of each adjustable support piece. Side 4045 slides into bent portion 4026 to adjust system 200. Bent portion 4026 also supports adjustable support pieces 404 and 406.

Figure 4G:
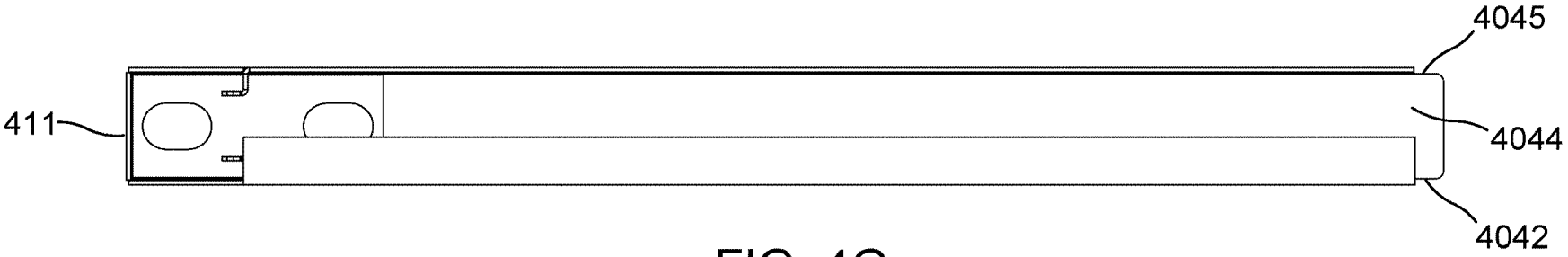
FIG. 4G illustrates a bottom view of the adjustable support piece according to the disclosed embodiments.
Figure 4H:
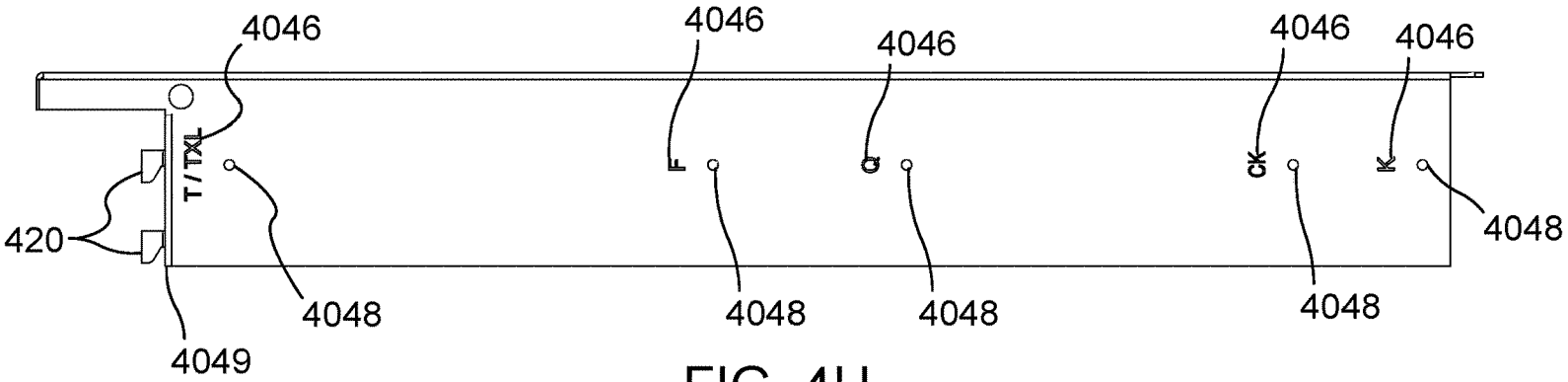
FIG. 4H illustrates a side view of the adjustable support piece according to the disclosed embodiments.

Flat support portion 4022 also provides support for adjustable support pieces while inside middle support piece 402. Flat section 4042 of each adjustable support piece 404 and 406 may rest on flat support portion 4022. Flat section 4042 is shown in FIG. 4G. Adjustable support piece 404 or 406 also includes a channel 4044 so that channels 4024 and 4044 overlap each other.

Figure 4I:
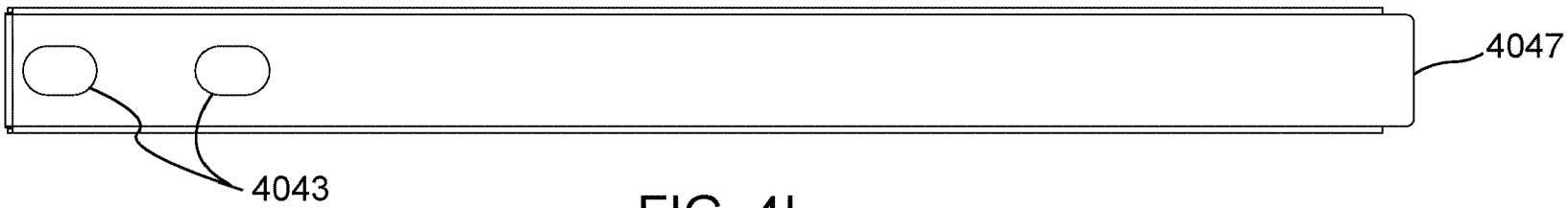
FIG. 4I illustrates a top view of the adjustable support piece according to the disclosed embodiments.
Figure 4J:
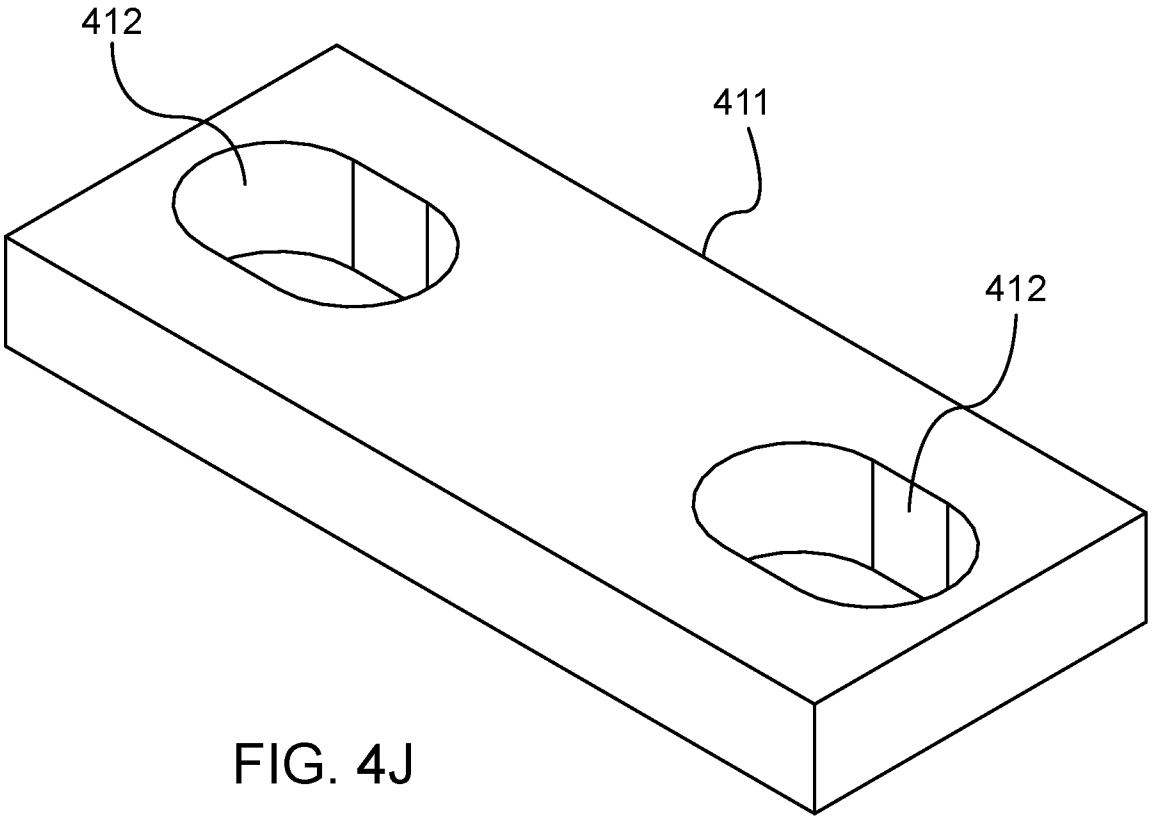
FIG. 4J illustrates a flatbar of the support rail of FIG. 4A according to the disclosed embodiments.

Adjustable support pieces 404 and 406 also include flatbars 411. Flatbar 411 is shown in FIG. 4J. Flatbar 411 includes holes 412. Hole 412 may have an oval shape and engage with leg 201. In other words, a hole 412 may overlap hollow center 308. Holes 412 also may allow pieces of furniture to be mounted on system 200. For example, a headboard may be fit into corresponding hole 412 for a bed. Flatbar 411 may be about 4 cm to 5 cm in length, and, more particularly, may be about 4.273 cm in length. Flatbar 411 may have a width of about 1.5 cm to 2 cm, and, more particularly, may be about 1.75 cm. Centers of holes 412 in each flatbar 411 may be about 2.5 cm to 3 cm apart. More particularly, the centers may be about 2.746 cm apart. As shown in FIGS. 4G and 4I, flatbar 411 may fit into an extension portion 4041 of each adjustable support piece. Adjustable support pieces 404 and 406 include holes 4043 to align with holes 412.

Preferred dimensions for middle support piece 402 and adjustable support pieces 404 and 406 may be provided. Middle support piece 402 may be about 35 cm to 40 cm in length, and, more particularly, about 38.74 cm in length. The distance between holes 4025 may be about 38 cm. The distance from an end of middle support piece 402 and a middle of slot 408 may be about 19.38 cm. The width of middle support piece 402 may be about 2 cm to 3 cm. More particularly, the width may be about 2.2 cm. The depth of middle support piece 402 may be about 3 cm to 3.5 cm. More particularly, the depth may be about 3.188 cm. A length of flat support portion 4022 may be about 1 cm. A length of bent portion 4026 may be about 0.50 cm.

Adjustable support pieces 404 and 406 may have a top side length of about 22 cm to 23 cm, and, more particularly, a top side length of 22.89 from an end 4047 of the adjustable support piece inserted into middle support piece and the end of extension portion 4041. The width of each adjustable support piece may be about 2 cm to fit within the width of middle support piece 402. The depth of each adjustable support piece may be about 3 cm to also fit within the depth of middle support piece 402. As shown in FIG. 4I, end 4047 narrows slightly from the width of adjustable support piece 404 or 406.

Mounting projections 420 project from end 4049 of each adjustable support piece. Mounting projections 420 fit into slots 304 and 306 of legs 201 to mount support rail 202 or 204. Preferably, there are four mounting projections 420 for each adjustable support piece 404 or 406. Mounting projections 420 may include a downwardly shaped portion that goes into the slots on legs 201 to mount to the legs. Mounting projections 420 should not dislodge from legs 201 absent some movement of the support rails to do so. FIGS. 4B and 4C depict support rail 202 in an extended configuration with adjustable support pieces 404 and 406 moved to the "full" bed configuration as shown by markings 4046. Adjustable support pieces 404 and 406 fit and move within middle support piece 402.

FIGS. 5A-G depict side rail 206 according to the disclosed embodiments. Side rail 208 also may include the configuration and concepts disclosed in FIGS. 5A-G. Side rails 206 and 208 attach to legs 201 using mounting projections 510. Mounting projections 510 insert into slots 304 and 306. Side rails 206 and 208 differ from support rails 202 and 204 in that they also include lips 508 and 509. Lips 508 and 509 provide support for a piece of furniture to rest upon. Side rails 206 and 208 also are adjustable to configure into a variety of sizes for system 200.

Figure 5A:
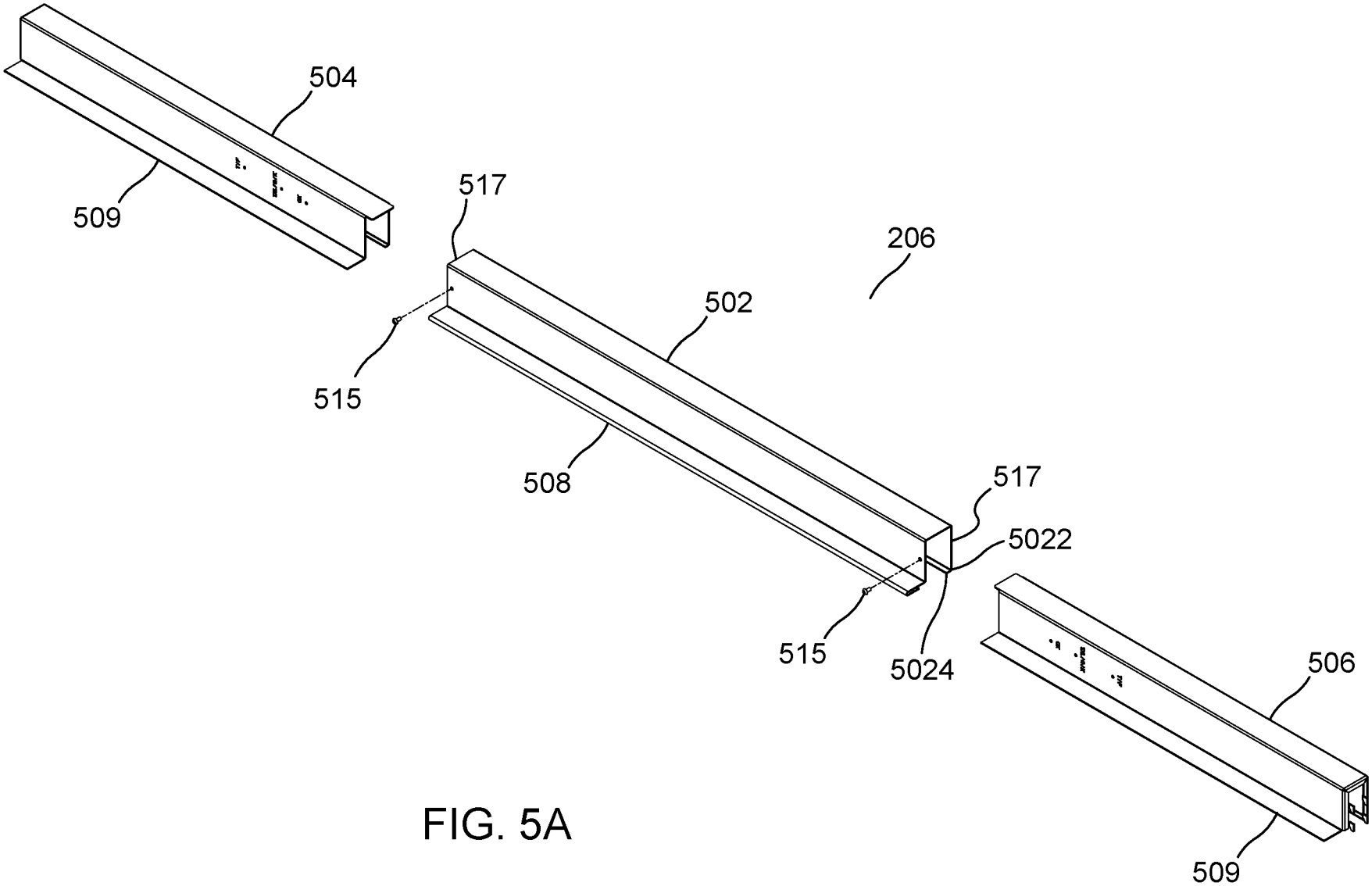
FIG. 5A illustrates an exploded view of a side rail for the adjustable modular frame system of FIG. 2B according to the disclosed embodiments.

Referring to FIG. 5A, the components of side rail 206 are shown. Side rail 206 includes middle side piece 502 having a lip 508 extending inwardly towards a center area enclosed by system 200. Side rail 206 also includes a pair of adjustable side pieces 504 and 506 that fit and move inside middle side piece 502. Adjustable side piece 504 may be referred to as the left adjustable side piece and adjustable side piece 506 may be referred to as the right adjustable side piece. Each adjustable side piece also includes a lip 509.

Side rail 206 includes holes 517 that receive screws 515 to adjust the length of the side rail using adjustable side pieces 504 and 506. Referring to FIG. 5F, markings 520 and holes 522 are shown. One moves adjustable side pieces 504 and 506 to a desired size, such as twin/full, queen/king, or California king, using markings 520. The appropriate hole 522 corresponding to the marking is aligned with hole 517 of middle side piece 502. Screw 515 is placed through holes 517 and 522 to secure the adjustable side piece to the middle side piece. This process is repeated for the other adjustable side piece.

Figure 5B:
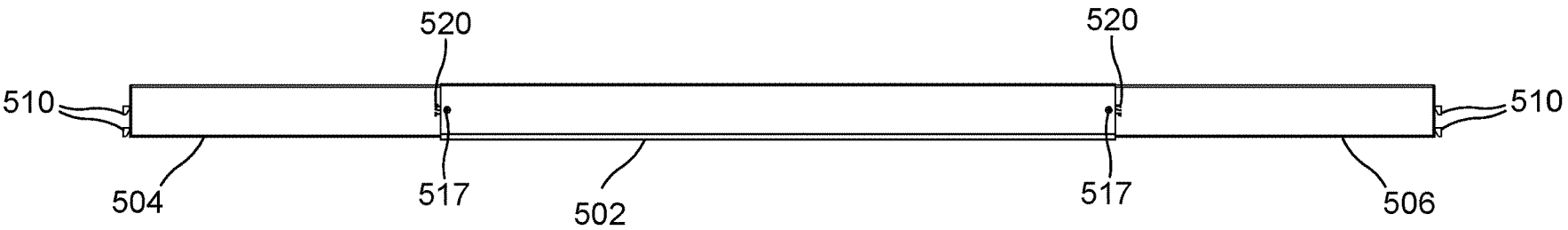
FIG. 5B illustrates a side view of the side rail according to the disclosed embodiments.

FIG. 5B depicts a side view of side rail 206. Mounting projections 510 are included on the ends of adjustable side pieces 504 and 506 opposite middle side piece 502. Like mounting projections 420, mounting projections 510 engage slots 304 and 306 of legs 201 to keep system 200 off of the floor. Preferably, there are four mounting projections 510 for each adjustable side piece 504 and 506. Mounting projections 510 may include a downwardly shaped portion that goes into the slots on legs 201 to mount to the legs. Mounting projections 510 should not dislodge from legs 201 absent some movement of the support rails to do so. Further, markings 520 and holes 517 for adjusting side piece 206 are shown.

Figure 5C:
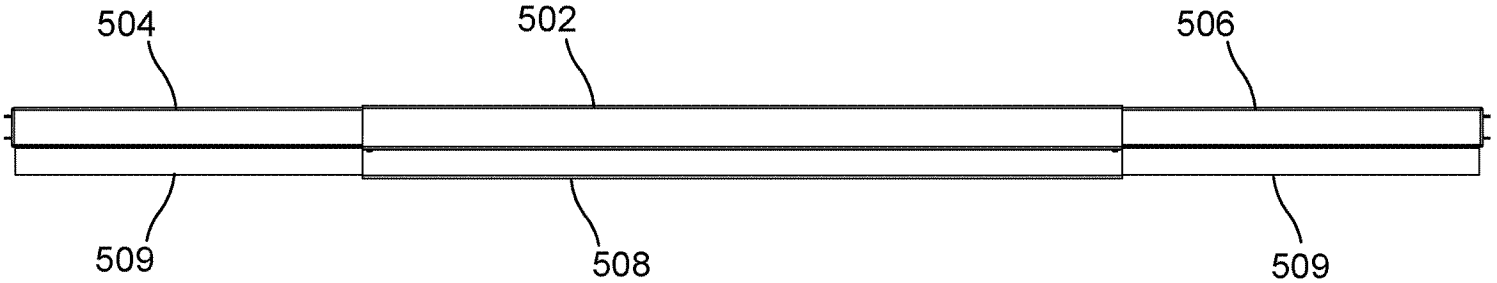
FIG. 5C illustrates a top view of the side rail according to the disclosed embodiments.

FIG. 5C depicts a top view of side rail 206. This figure shows lips 508 and 509 used to support furniture or other items using system 200. Lips 509 may be slightly smaller than lip 508. As adjustable side pieces 504 and 506 move within middle side piece 502, lips 509 are positioned below lip 508. Thus, lip 508 may rest on lips 509. This configuration may prevent buckling of side piece 206 once weight is placed on lips 508 and 509.

Figure 5D:
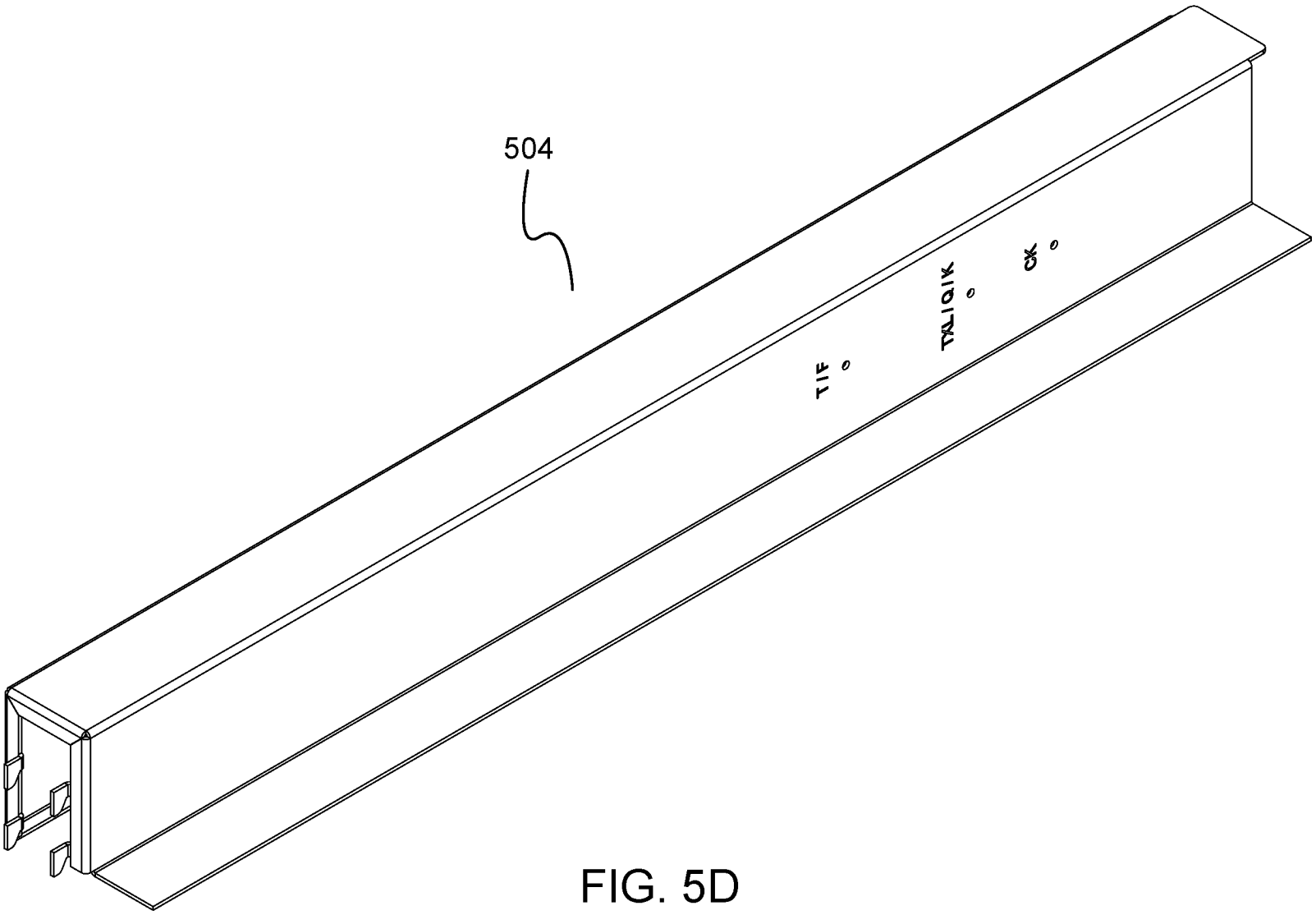
FIG. 5D illustrates a perspective view of an adjustable side piece of the side rail of FIG. 5A according to the disclosed embodiments.
Figure 5E:
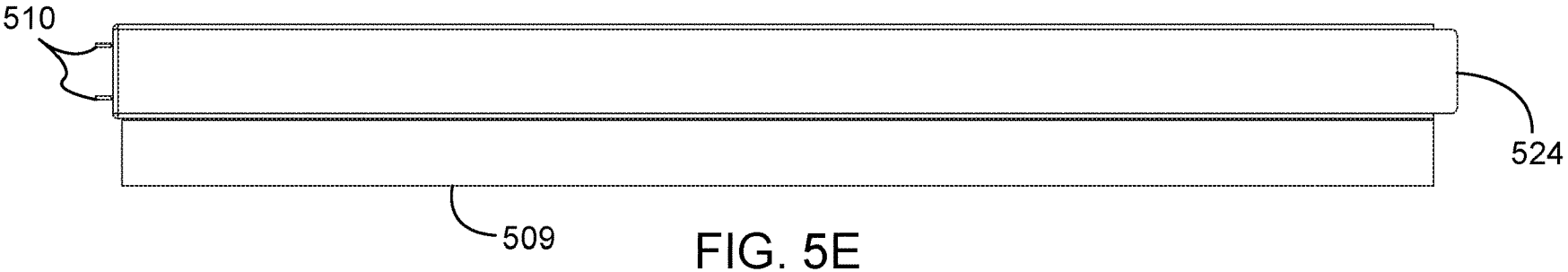
FIG. 5E illustrates a top view of the adjustable side piece according to the disclosed embodiments.
Figure 5F:
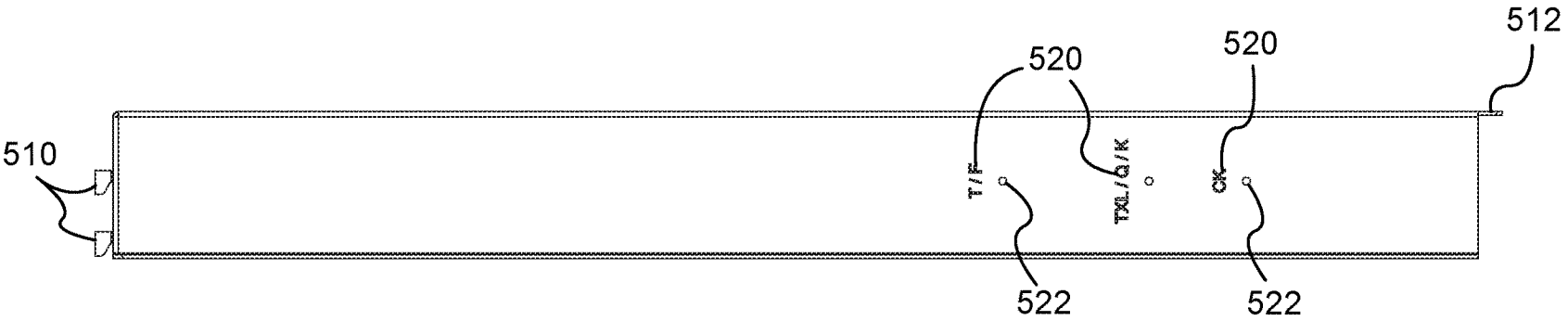
FIG. 5F illustrates a side view of the adjustable side piece according to the disclosed embodiments.
Figure 5G:
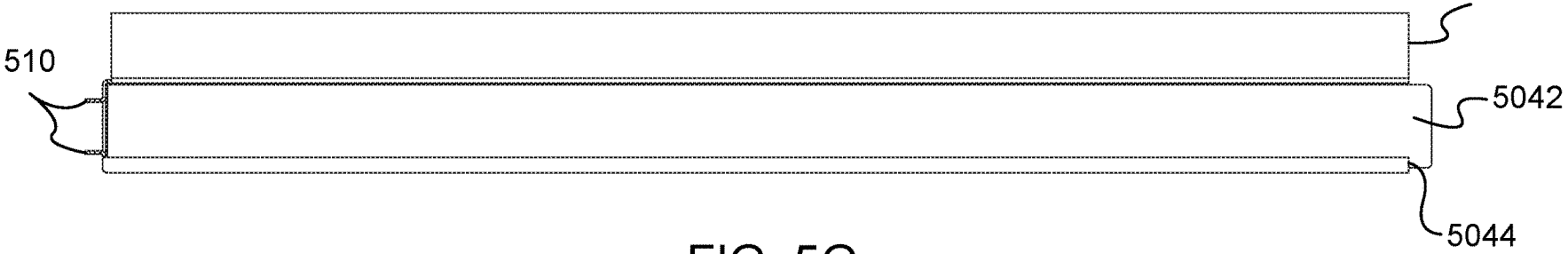
FIG. 5G illustrates a bottom view of the adjustable side piece according to the disclosed embodiments.

FIGS. 5D-G depict more detailed views of adjustable side piece 504 or 506. Adjustable side piece 504 is referred to in the following description for simplicity. FIG. 5D depicts a perspective view of adjustable side piece 504. FIG. 5E depicts a top view, FIG. 5F depicts a side view, and FIG. 5G depicts a bottom view. End 524 of adjustable side piece 504 may be tapered slightly to better fit into middle side piece 502. The bottom side includes channel 5042 and flat section 5044. Flat section 5044 may rest on flat support portion 5022 of middle side piece 502. Thus, middle side piece 502 also includes a channel 5024 on its bottom to allow lip 509 to connect to adjustable side piece 504.

Preferred dimensions for adjustable side piece 504 include a length of about 28 cm to 29 cm. More particularly, the length is about 28.5 cm. A length to the beginning of the tapered portion of end 524 is about 28 cm. Adjustable side piece 504 also may have a width of about 1.5 cm to 2.5 cm, or, more particularly, a width of about 2.0 cm. It also may have a depth of about 2.5 cm to 3.5 cm. More particularly, the depth may be about 3.0 cm to flat section 5044 and 3.03 cm to lip 509. Thus, the side of adjustable side piece 504 having lip 509 is longer than the opposite side. This configuration allows adjustable side piece 504 to fit and move within middle side piece 502. The length of lip 509 may be about 1.5 cm and the length of flat section 5044 may be about 0.875 cm.

FIGS. 6A-E depict center rail 210 of system 200 according to the disclosed embodiments. Referring back to FIG. 2B, center rail 210 fits between top support rail 202 and bottom support rail 204. Center rail 210 also is adjustable to fit the desired configuration of system 200. Center rail 210 includes middle center piece 602 and a pair of connecting pieces 604 and 606 that slidably fit into the middle center piece. Connecting pieces 604 and 606 may move within middle center piece 602 to adjust the length of center rail 210. These components of center rail 210 may vary in thickness to make this component more rigid. In other words, if center rail 210 is made thicker, then it also is more rigid to provide more support.

Figure 6A:
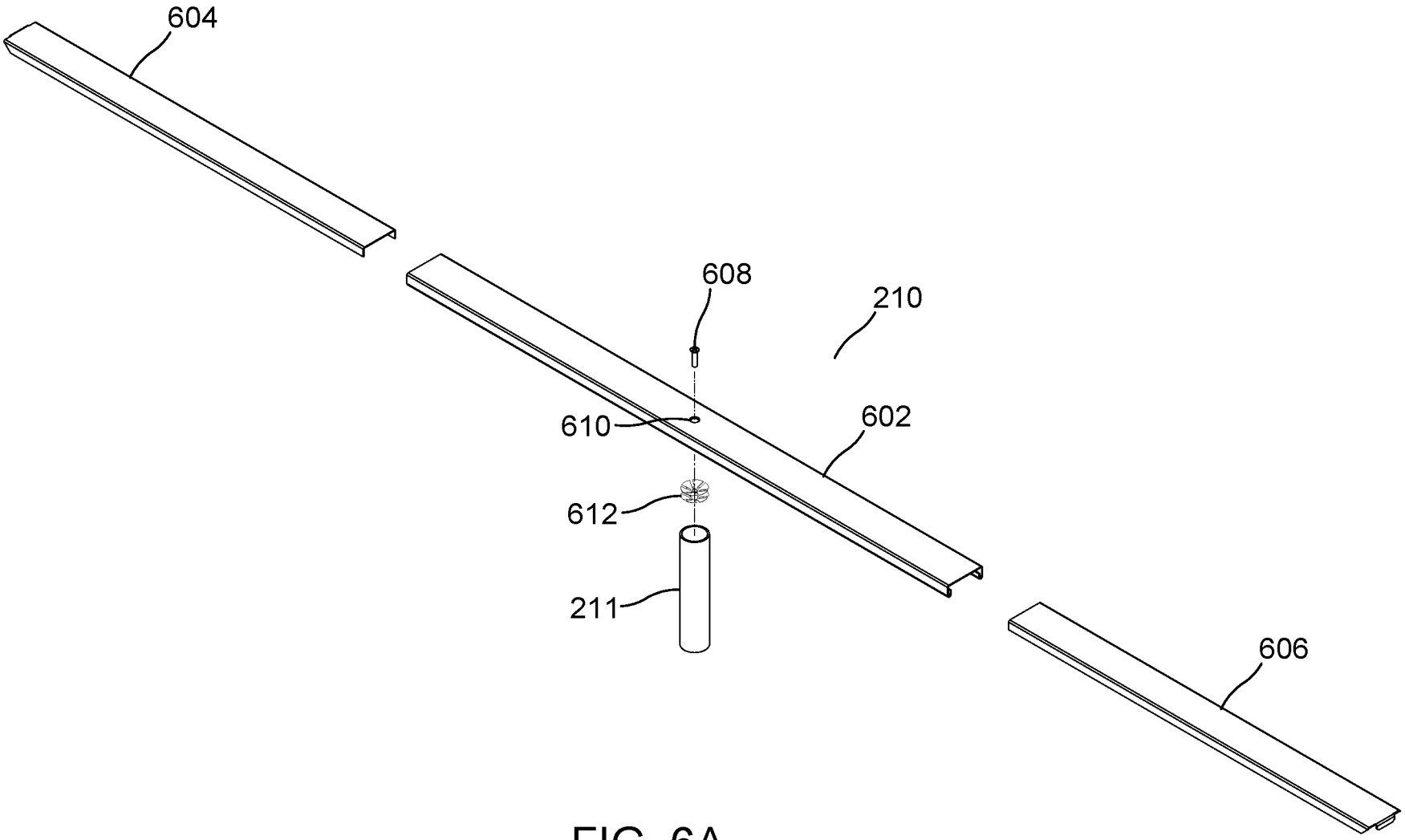
FIG. 6A illustrates an exploded view of a center rail for the adjustable modular frame system of FIG. 2B according to the disclosed embodiments.
Figure 6B:
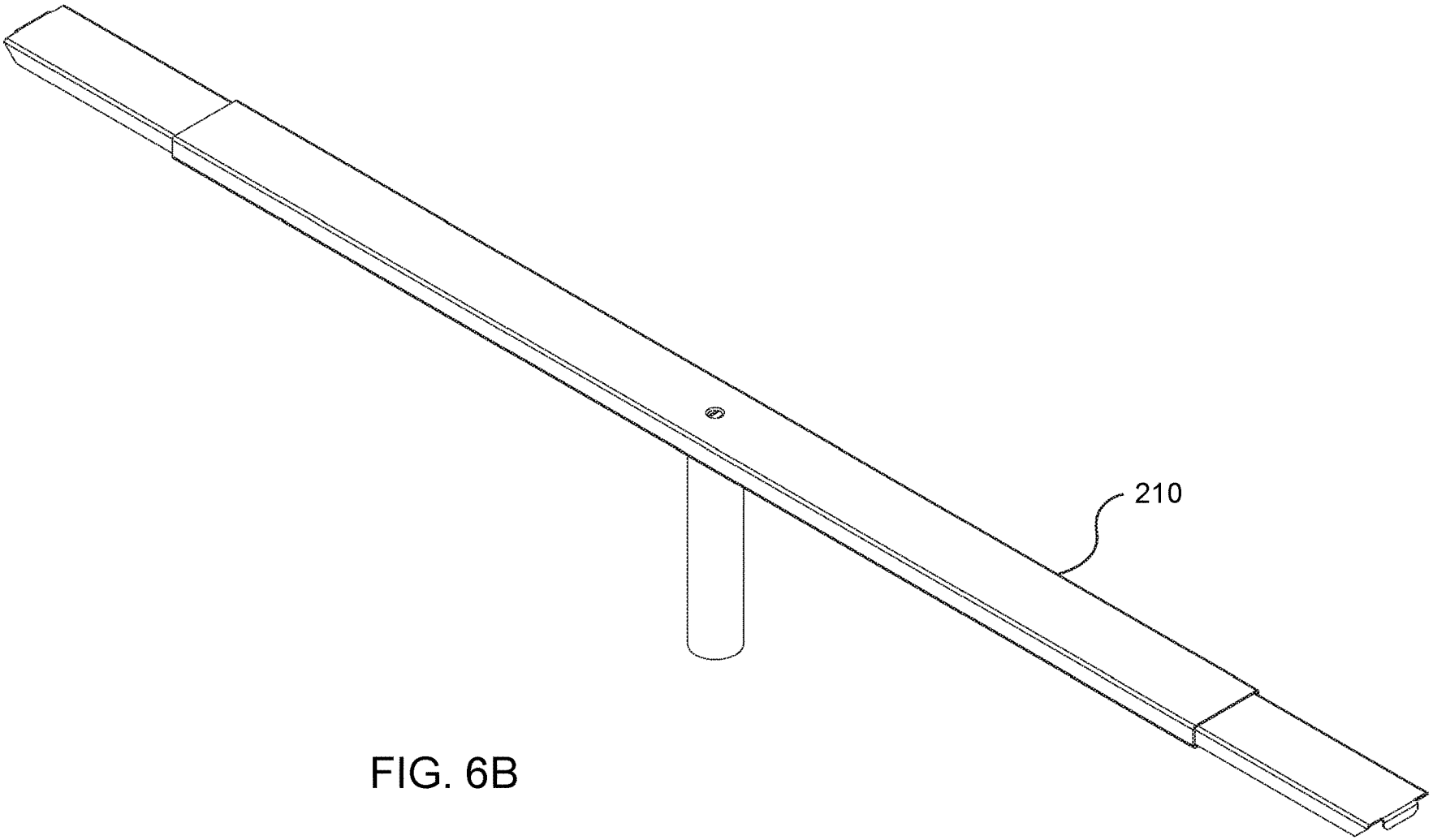
FIG. 6B illustrates a perspective view of the center rail according to the disclosed embodiments.
Figure 6C:
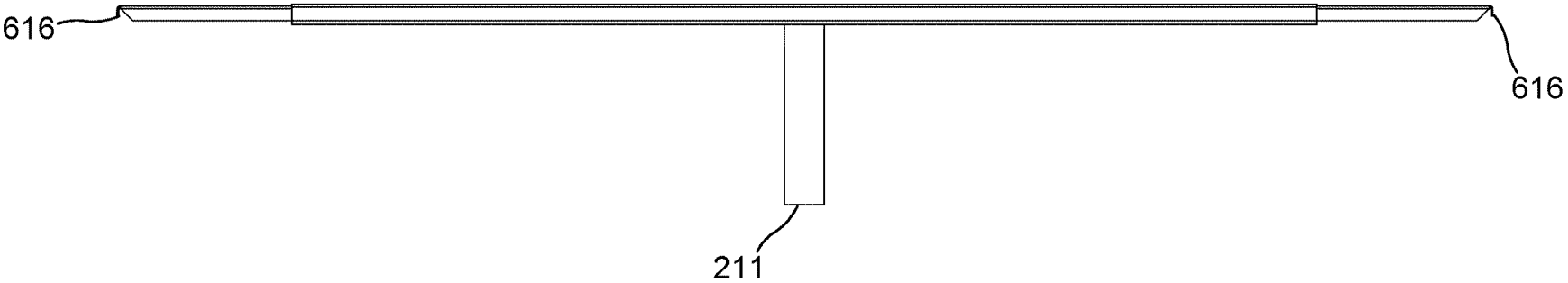
FIG. 6C illustrates a side view of the center rail according to the disclosed embodiments.
Figure 6D:
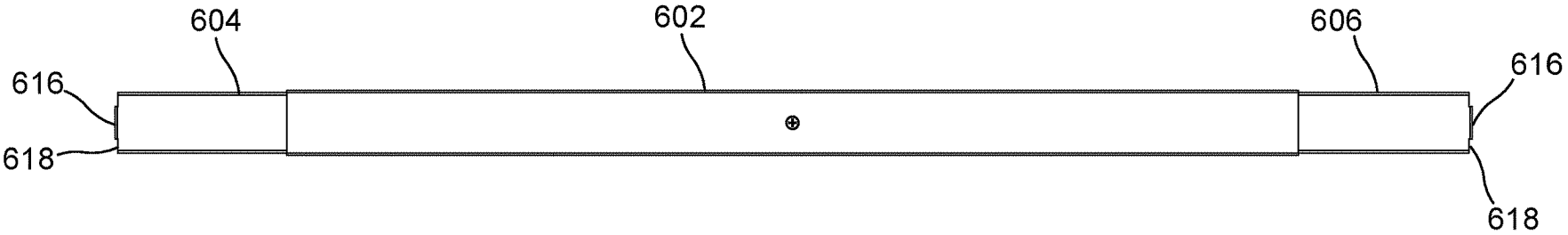
FIG. 6D illustrates a top view of the center rail according to the disclosed embodiments.
Figure 6E:
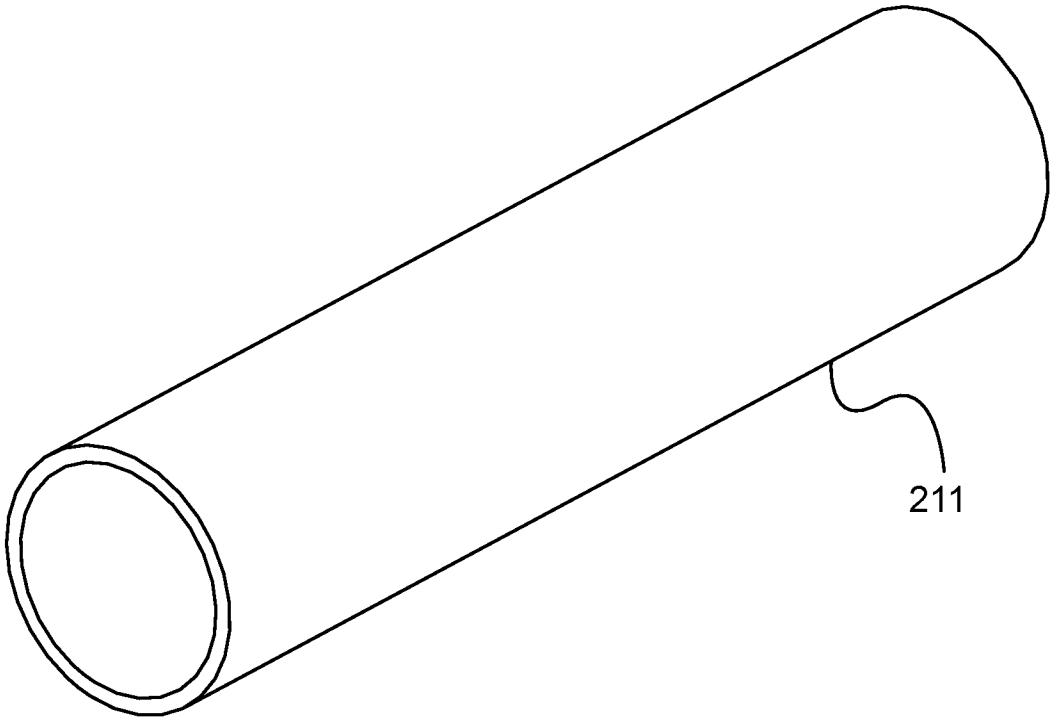
FIG. 6E illustrates a leg piece of the center rail according to the disclosed embodiments.

Middle center piece 602 also connects to leg piece 211. Leg piece 211 provides support to center rail 210 as it does not connect to legs 201. Leg piece 211 prevents center rail from buckling or bending towards the floor, and also provides the necessary clearance underneath any furniture item supported by system 200. Screw 608 inserts through hole 610 to engage washer 612. Washer 612 fits into a top of leg piece 211. Washer 612 also may be referred to as a fitting having a hole to receive screw 608. FIG. 6E shows an example of leg piece 211. Leg piece 211 may be round with a hollow center.

Connecting pieces 604 and 606 then may be placed into middle center piece 602. Connecting pieces 604 and 606 are configured to fit into the midsection of middle center piece 602. As shown, pieces 602, 604, and 606 are thin, substantially flat pieces so that the furniture item can rest on center rail 210 without snagging any material. They also have a rounded top section to not tear or snag material as well as allow for some movement of the furniture item when placed on system 200.

Connecting pieces 604 and 606 each include a tab 616. Tab 616 may be shown in FIGS. 6C and 6D. Tabs 616 are located on ends 618 of connecting pieces 604 and 606. Tabs 616 are placed into slots 408 of support rails 202 and 204. Tabs 616 extend substantially downward to hook into slots 408. Thus, center rail 210 is located substantially in the middle of system 200. Center rail 210 may have a height of about 6.5 cm to 7.2 cm from the top of middle center piece 602 and the bottom of leg piece 211. More particularly, the height may be 6.95 cm.

In some embodiments, more than one center rail 210 may be implemented in system 200. In such a case, middle support piece 402 may include multiple slots 408 to receive tabs 616 from the center rails. Multiple center rails may be desired for a large system 200, or when the furniture item is heavy such that the system needs extra support. Center rail 210 preferably is configured "length-wise" within system 200 but may be configured "width-wise" in that tabs 616 engage slots within middle side piece 502. Alternatively, more than one leg piece 211 may be connected to middle center piece 602 to provide extra support.

Although system 200, as well as system 100, discloses the use of markings and holes that correspond to sizes of beds, the embodiments are not so limited. Any number of holes may be used to adjust the size of system 200. For example, a plurality of holes may be used on adjustable support pieces 404 and 406 as well as adjustable side pieces 504 and 506. These holes may be spaced apart at uniform distances and not according to predetermined sizes. Thus, system 200 may accommodate many different types of furniture configurations beyond beds, such as couches, chairs, and the like. Alternatively, adjustable pieces 404, 406, 504, and 506 may have notches that fit into notches in middle pieces 402 and 502. Each notch may include a hole corresponding to its location so that one may count how many notches for each adjustable piece. Then the screws are fit through the holes to construct system 200.

Figure 7D:
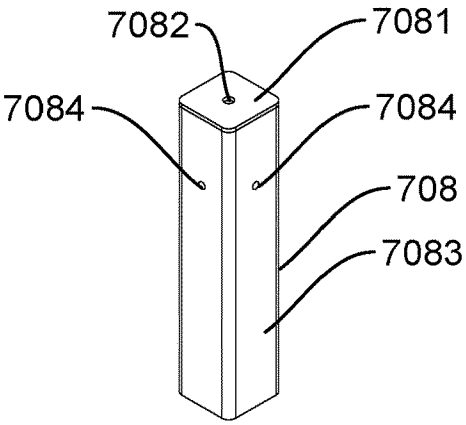
FIG. 7D illustrates a perspective view of a corner leg piece according to the disclosed embodiments.
Figure 7C:
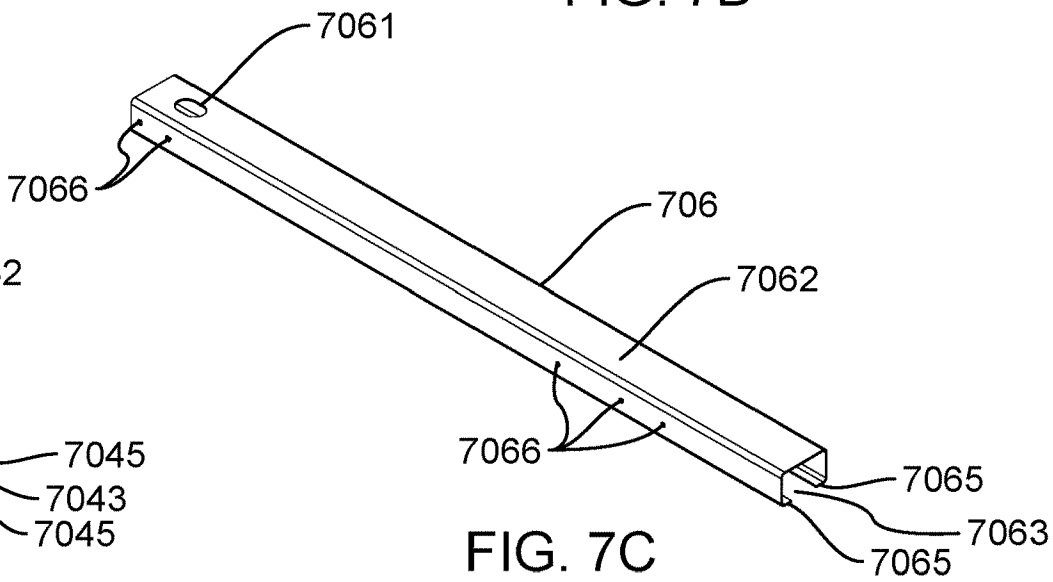
FIG. 7C illustrates a perspective view of a long channel piece according to the disclosed embodiments.
Figure 7A:
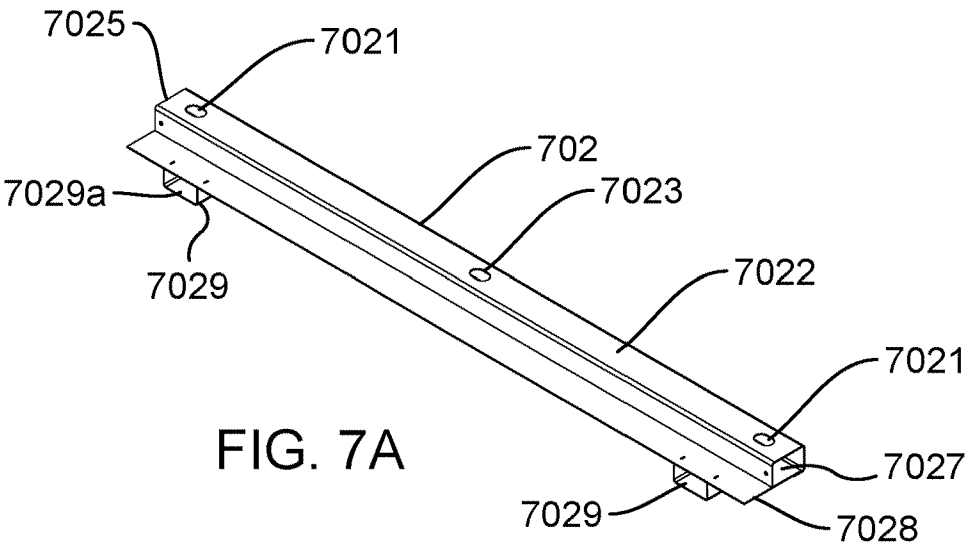
FIG. 7A illustrates a perspective view of a housing piece according to the disclosed embodiments.
Figure 7B:
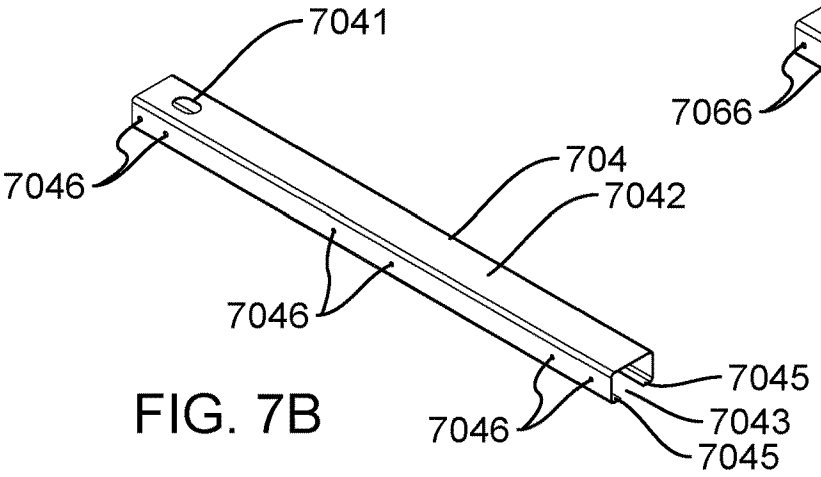
FIG. 7B illustrates a perspective view of a short channel piece according to the disclosed embodiments.
Figure 7F:
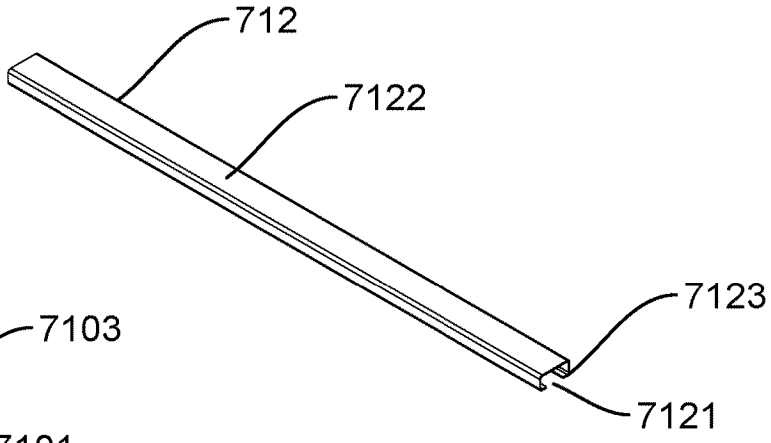
FIG. 7F illustrates a perspective view of a strut extension piece according to the disclosed embodiments.
Figure 7E:
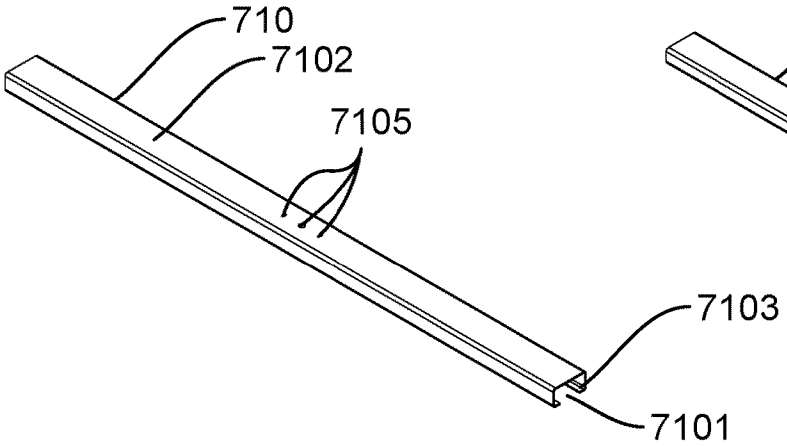
FIG. 7E illustrates a perspective view of a strut housing piece according to the disclosed embodiments.
Figure 7H:
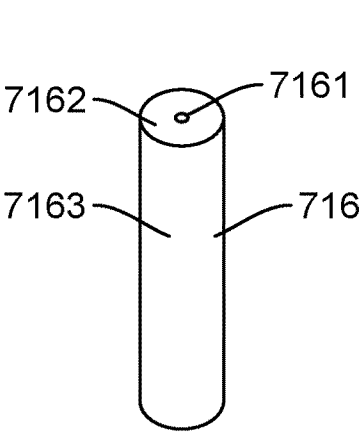
FIG. 7H illustrates a perspective view of a center leg piece according to the disclosed embodiments.
Figure 7G:
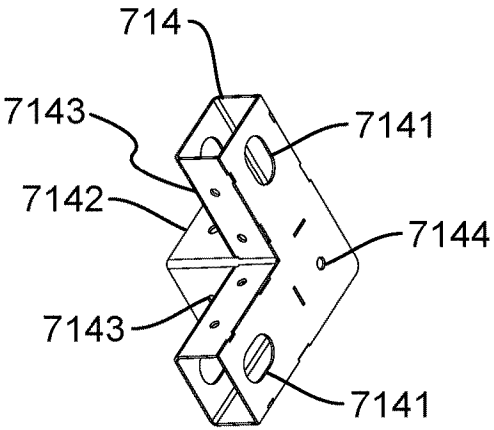
FIG. 7G illustrates a perspective view of a corner piece according to the disclosed embodiments.
Figure 7I:
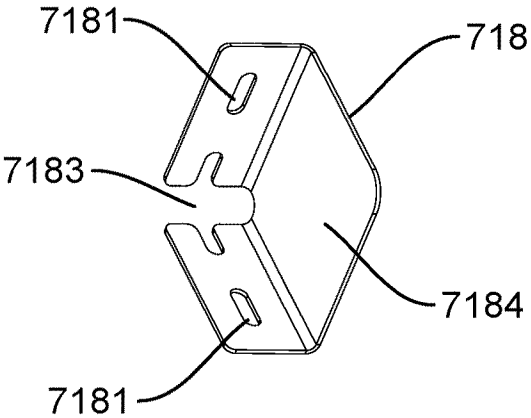
FIG. 7I illustrates a perspective view of a bracket piece according to the disclosed embodiments.
Figure 8:
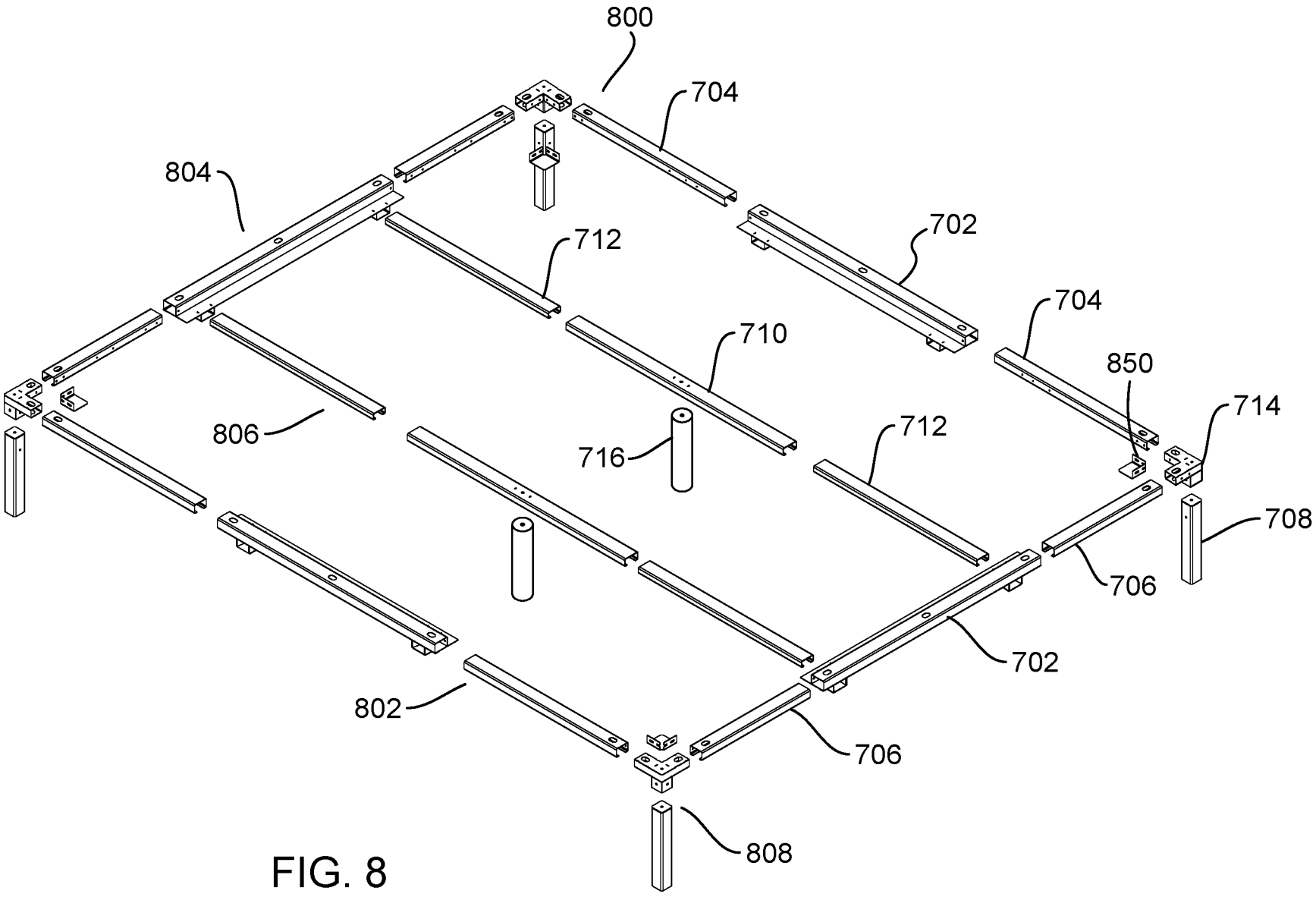
FIG. 8 illustrates an exploded view of an adjustable modular frame system according to the disclosed embodiments.

FIGS. 7A-I and 8 depict another adjustable modular frame system 800 according to the disclosed embodiments. As with the embodiments disclosed above, system 800 is adjustable to fit a variety of mattresses and furniture support. FIGS. 7A-I depict the pieces used in system 800 while FIG. 8 depicts an assembled view of system 800 using main bar rails 802, side bar rails 804, center bar rails 806, and corner assemblies 808.

FIG. 7A depicts a perspective view of housing piece 702 according to the disclosed embodiments. System 800 may use housing piece 702 as a main housing piece in main bar rail 802 and a side housing piece in side bar rail 804. Housing piece 702 may be a hollow rectangular passage 7025 with a shorter inner edge that has a triangular lip connection 7027 to the base of the passage. Hollow passage 7025 also includes a top surface 7022 that faces upward from the floor when system 800 is assembled. Hollow passage 7025 acts as the bridge protector between a pair of component parts, such as short channel pieces 704 or long channel pieces 706. Housing piece 702 allows the frame for system 800 to extend or contract without any damage to the underlying infrastructure.

Housing piece 702 also acts as a holding piece for center bar rails 806. Receiving portions 7029 include openings 7029A to receive an end of a strut extension piece 712. The other end of a center bar rail 806 is received in a corresponding receiving portion 7029 in the housing piece located in the opposite side bar rail. Receiving portions 7029 may be rectangular in shape in order to fit the ends of strut extension pieces 712. Housing piece 702 also include rectangular lip 7028 that extends outwardly from hollow passage 7025. Receiving portions 7029 also are attached to the bottom side of rectangular lip 7028. Receiving portions 7029 may be oriented perpendicular to hollow passage 7025 of housing piece 702.

Housing piece 702 includes end holes 7021 and center hole 7023. Holes 7021 and 7023 may act like the holes disclosed above to secure channel pieces to form the rails. As shown in FIG. 8, a housing piece 702 is located in each main bar rail 802 and side bar rail 804. Holes 7021 and 7023 also allow the user to see how far in a channel piece is when assembled with housing piece 702. The dimensions of the rectangular housing for hollow passage 7025 may be about 1016 by 110.1852 by 70.993 millimeters (mm). Rectangular lip 7028 may have a width of 50.8 mm and a length as long as housing piece 702. Receiving portions 7029 may include dimensions of 88.99 by 62.586 by 30.124 mm Although two receiving portions 7029 are shown, any number of receiving portions may be used in housing piece 702.

FIG. 7B depicts a perspective view of short channel piece 704 according to the disclosed embodiments. Short channel piece 704 also may be known as a short extruder channel piece. One end of short channel piece 704 includes hole 7041. This end connects to corner assembly 808. The other end is connected to housing piece 702. Short channel piece 704 includes top surface 7042 and channel 7043 located opposite to the top surface. Thus, short channel piece 704 is not completely enclosed as channel 7043 provides an opening into the interior of the short channel piece.

Channel 7043 includes bent portions 7045 extending into the channel. Short channel piece 704 is, therefore, hollow to reduce the weight associated with system 800. Secure holes 7046 are provided in short channel piece 704 to receive screws to further secure other pieces of system 800.

Short channel pieces 704 in main bar rail 802 may include a pair of rectangular U channel tubes that connects on one end as a male part and on the opposite end as a female part. Short channel pieces 704 are the mechanism by which the frame for system 800 expands or contracts depending on the depth of entry or fit in housing piece 702. Referring to FIG. 8, the end of a short channel piece 704 in main bar rail 802 connected to corner assembly 808 receives a portion of corner piece 714. Hole 7041 couples with a hole 7141 of the corner piece. On the opposite end, short channel piece 704 is inserted into housing piece 702. One of secure holes 7046 align with a secure hole 7024 of housing piece 702 to provide the desired length for main bar rail 802.

Short channel piece 704 may have a dimension of 504.825 mm by 55.753 mm by 35.357 mm. The width of the space between the bottom edges that form channel 7043 may be about 30.328 mm.

FIG. 7C depicts a perspective view of long channel piece 706 according to the disclosed embodiments. Long channel piece 706 acts like a short channel piece 704. Long channel piece 706 may include a hole 7061 that is inserted into a corner assembly 808 while the opposite end of the piece is inserted into a housing piece 702. Long channel piece 706 includes a top surface 7062. A channel 7063 is located on the bottom of long channel piece 706 so that the piece is not completely enclosed. Bent portions 7063 extend inwardly to channel 7063. As with short channel piece 704, long channel piece 706 is hollow to reduce the overall weight of system 800. Secure holes 7066 are provided to receive screws to further secure other pieces of system 800.

Long channel pieces 706 in a side bar rail 804 may include a pair of rectangular U channel tubes that connects on one end as a male part and on the opposite end as a female part. Short channel pieces 706 also serve as the mechanism by which the frame for system 800 expands or contracts depending on the depth of entry or fit in housing piece 702. Referring to FIG. 8, the end of a short channel piece 706 in side bar rail 804 connected to corner assembly 808 receives a portion of corner piece 714. Hole 7061 couples with a hole 7141 of the corner piece. On the opposite end, long channel piece 706 is inserted into housing piece 702. One of secure holes 7066 align with a secure hole 7024 of housing piece 702 to provide the desired length for side bar rail 804.

Long channel piece 706 may have a dimension of 711.2 mm by 55.728 mm by 35.357 mm. The width of the space between the bottom edges that form channel 7063 may be about 30.328 mm. Thus, channel 7063 may have the same width of channel 7043 of short channel piece 704.

FIG. 7D depicts a perspective view of corner leg piece 708 according to the disclosed embodiments. Corner leg piece 708 includes side surfaces 7083 having rectangular shapes. Corner leg piece 708 also includes a top surface 7081 that is received in corner piece 714, as disclose below. Corner piece 708 may be secured to corner piece 714 using hole 7082. Side surfaces 7083 include secure holes 7084 that align with secure holes 7143 of corner piece 714. The secure holes provide stability when corner leg piece 708 is incorporated into corner assembly 808.

FIG. 7E depicts a perspective view of a strut housing piece 710 according to the disclosed embodiments. Strut housing piece 710 may form the center piece of center bar rail 806. Strut housing piece 710 includes top surface 7102 that faces the mattress or furniture supported by system 800. Strut housing piece 710 also includes a channel 7101 at the bottom of the piece opposite top surface 7102. Strut housing piece 710, therefore is not enclosed and may have a hollow passage therewithin. Bent portion 7103 extends inwardly to channel 7101.

Strut housing piece 710 is a horizontal rectangular tube that placed at a 90 degree angle to a vertical tube, or center leg 716. Center leg 716 is screwed into a rectangular connector to hold it in place using secure holes 7105. Strut housing 710 constrains and guides strut extension pieces 712 as they are extended to connect to housing pieces 702. The dimensions of strut housing piece 710 may be 1016 mm by 62.587 mm by 30.836 mm. The width of the space between the bottom edges, or channel 7101, may be about 37.187 mm. The dimension of the connector is 34.925 mm by 28.626 mm.

FIG. 7F depicts a perspective view of a strut extension piece 712 according to the disclosed embodiments. A pair of strut extension pieces 712 join with strut housing piece 710 to form center bar rail 806. An end of each strut extension piece 712 is inserted into a receiving portion 7029 of housing piece 702. Strut extension piece 712 includes top surface 7122 to face the mattress or furniture supported by system 800. Channel 7121 is located at the bottom of strut extension piece 712 opposite top surface 7122. Bent portion 7123 extends inwardly to channel 7121. It should be noted that strut extension piece may not include any holes or secure holes and slides into strut housing piece 710 as well as receiving portion 7029.

Strut extension piece 712 may be a rectangular U channel tube that connects with housing piece 702 on one end and strut housing piece 710 on the other end. Strut extension piece 712 fits into receiving portion 7029 underneath rectangular lip 7028 on housing piece 702. The connection to strut housing piece 710, however, is a sliding mechanism, guided by the strut housing piece, to extend or shorten the distance between the housing piece and the strut housing piece. The dimensions of strut extension piece 712 may be a length of 860 mm, an outer height of 150 mm, and an inner height of 120 mm. A width of the top edge is 70 mm and the width of the lower edge is 73 mm. The base of the triangular lip is 30 mm.

FIG. 7G depicts a perspective view of a corner piece 714 according to the disclosed embodiments. Each corner assembly 808 includes a corner piece 714. Some features of corner piece 714 are disclosed above. Arms 7146 extend perpendicularly from each other and may act as a male part to join with a long channel piece 706 on one arm and a short channel piece 704 on the other arm. Arms 7146 include holes 7141 to align with respective holes on pieces 704 and 706. Each arm fits within the respective channel piece.

Corner piece 714 also includes leg receiving portion 7142 that goes on top of center leg piece 708. Using holes 7143, receiving portion 7142 is attached to center leg piece 708 using holes 7084. Receiving portion 7142 is at a perpendicular angle to arms 7146. Upon connecting with main body rail 802 and side body rail 804, corner piece 714 seats on corner leg piece 708 to cover only a portion of the corner leg piece. The dimensions of corner piece 714 may be a length of 990 mm, a height of 150 mm, and a width of 70 mm for the encasement.

FIG. 7H depicts a perspective view of a center leg piece 716 according to the disclosed embodiments. As disclosed above, center leg piece 716 attaches to strut housing piece 710 using secure hole 7161 aligned with one of holes 7105. Center leg piece 716 includes top surface 7162 and outer surface 7163. Center leg piece 716 may have a circular shape that fits into a connector in strut housing piece 710.

FIG. 7G depicts a perspective view of a bracket piece 718 according to the disclosed embodiments. Bracket piece 718 may be an L-shaped component accessory used in corner assembly 808 that acts as a supporting lever to the mattress slats. Bottom surface 7184 may face away from the mattress or furniture when bracket piece 718 is on corner piece 714. Bracket piece 718 includes screw or alignment holes 7181 and opening 7183. Bracket piece 718 connects, via screws, to a short channel piece 704, a long channel piece 706, a corner piece 714 and a corner leg piece 708. Bracket piece 718 may serve to hold corner assembly 808 in place and prevent any screws or other surfaces from contacting the mattress, which reduces the possibility of tearing the covering of the mattress or furniture. The dimensions for bracket piece 718 may be a length of 990 mm, a height of 150 mm, and a width of 70 mm.

FIG. 8 depicts system 800 according to the disclosed embodiments. As shown, system 800 includes two main bar rails 802, two side bar rails 804, two center bar rails 806, and four corner assemblies 808. The components of the rails and assemblies are disclosed above. Each main bar rail 802 includes a main housing piece 702 and two short channel pieces 704 that attach to the housing piece and the appropriate corner assembly 808. The main bar rails may correspond to the head and foot of a bed supported by system 800.

Each side bar rail 804 includes a side housing piece 702 and two long channel pieces 706. Each long channel piece 706 attaches to side housing piece 702 on one end and a corner assembly 808 on the other end. Side bar rails 804 may correspond to the sides of a bed or mattress. Each center bar rail 806 includes a strut housing piece 710 and two strut extension pieces 712. Center bar rail 806 also includes a center leg piece 716 connected to strut housing piece 710. The ends of each strut extension piece 712 goes into an end of strut housing piece 710 and a receiving portion 7029 of side housing piece 702. The two center bar rails may be parallel to each other.

System 800 may be assembled as follows. First, side bar rails 804 are assembled by sliding each long channel piece 706 into both ends of side housing piece 702. Each long channel piece 706 is aligned at a position to fit the size of the mattress or furniture. The secure holes in each piece may be used to attach the pieces to each other. Next, main bar rail 802 is assembled by sliding each short channel piece 704 into both ends of main housing piece 702 and aligned according to position of size label to fit with the size of the mattress or furniture. As disclosed above, sizes may be indicated on the pieces to properly align them within system 800.

Each center bar rail 806 is assembled by sliding each strut extension piece 712 into strut housing piece 710. Center leg piece 716 is attached to strut housing piece 710. The corresponding ends of the strut extension pieces are inserted into receiving portions 7029. This process may occur after the rest of system 800 is assembled.

Corner assemblies 808 are assembled using corner pieces 714, corner leg pieces 708, and bracket pieces 718. These pieces are connected using screws and the aligned holes. System 800 is then assembled by attaching main bar rails 802 and side bar rails 804 onto the appropriate arms 7146 of corner piece 714. Once the rails are in place, bracket piece 718 is placed on the inside of corner piece 714 and screwed into place as shown in FIG. 8.

It will be apparent to those skilled in the art that various modifications to the disclosed golf teaching aid system without departing from the spirit or scope of the invention. Thus, it is intended that the present invention covers the modifications and variations disclosed above provided that these changes come within the scope of the claims and their equivalents.

The invention claimed is:

1. An adjustable modular frame system comprising:

a plurality of corner assemblies placed in each corner of the system, each corner assembly includes a corner piece attachable to a corner leg piece and a bracket piece attached to the corner piece and the corner leg piece;

a pair of main bar rails located opposite each other, wherein each main bar rail includes a main housing piece having an enclosed passage that extends the length of the main housing piece, the main housing piece includes two receiving portions on the bottom of the main housing piece, and a pair of short channel pieces movable within the main housing piece to adjust a length of the main bar rail, wherein each short channel piece fits into the enclosed passage of the main housing piece;

a pair of side bar rails located opposite each other, wherein each side bar rail includes a side housing piece also having an enclosed passage that extends the length of the side housing piece, the side housing piece includes two receiving portions on the bottom of the side housing piece, and a pair of long channel pieces movable within the side housing piece to adjust a length of the side bar rail, wherein each long channel piece fits into the enclosed passage of the side housing piece; and two center bar rails to connect to the pair of side bar rails, wherein each of the center bar rails includes a strut housing piece connected to a center leg piece, and a pair of strut extension pieces to slidably fit into the strut housing piece, wherein each strut extension piece includes an end that fits into a receiving portion of the side housing piece, wherein each corner assembly receives an end from a side bar rail and an end from a main bar rail.

2. The adjustable modular frame system of claim 1, wherein the each of the short channel pieces includes a channel at the bottom of the piece.

3. The adjustable modular frame system of claim 2, wherein the each of the short channel pieces includes bent portions that bend inwardly into the channel.

4. The adjustable modular frame system of claim 1, wherein the each of the long channel pieces incudes a channel at the bottom of the piece.

5. The adjustable modular frame system of claim 4, wherein the each of the long channel pieces includes bent portions that bend inwardly into the channel.

6. The adjustable modular frame system of claim 1, wherein the main housing piece includes an extension portion that extends from the bottom of the main housing piece to support the two receiving portions.

7. The adjustable modular frame system of claim 1, wherein the side housing piece includes an extension portion that extends from the bottom of the side housing piece to support the two receiving portions.

8. The adjustable modular frame system of claim 1, wherein the two receiving portions are perpendicular to the enclosed passage of the side housing piece.

9. The adjustable modular frame system of claim 1, wherein the bracket piece fits against the corner piece and includes a flat surface.

10. An adjustable modular frame system comprising:

four corner assemblies positioned in each corner of the frame system, wherein each corner assembly includes a corner piece and a corner leg piece;

two main bar rails located opposite each other and between the corner assemblies, each main bar rail includes a main housing piece and two short channel pieces, wherein each short channel piece connects to a first arm of the corner piece;

two side bar rails located opposite each other and between the corner assemblies, and perpendicular to the two main bar rails, each side bar rail includes a side housing piece and two long channel pieces, wherein each long channel piece connects to a second arm of the corner piece; and two center bar rails located parallel to each other and between the side housing pieces of the two side bar rails, each center bar rail includes a strut housing piece to receive two strut extension pieces and a center leg piece, wherein each strut extension piece is connected to the side housing piece, wherein the two main bar rails, the two side bar rails, and the two center bar rails are aligned to fit a specified size of a mattress or furniture.

* * * * *